US012569025B2

(12) United States Patent
Hatfield et al.

(10) Patent No.: US 12,569,025 B2
(45) Date of Patent: Mar. 10, 2026

(54) FOOTWEAR STRUCTURES PROVIDING COMPRESSION AND THERMAL TREATMENT

(71) Applicant: NIKE, Inc., Beaverton, OR (US)

(72) Inventors: Tobie D. Hatfield, Lake Oswego, OR (US); Andrew A. Owings, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 18/785,284

(22) Filed: Jul. 26, 2024

(65) Prior Publication Data

US 2025/0031803 A1 Jan. 30, 2025

Related U.S. Application Data

(60) Provisional application No. 63/529,402, filed on Jul. 28, 2023.

(51) Int. Cl.

| | |
|---|---|
| ***A43B 3/34*** | (2022.01) |
| ***A43B 7/02*** | (2022.01) |
| ***A43B 7/083*** | (2022.01) |
| ***A43B 7/14*** | (2022.01) |
| ***A43B 23/02*** | (2006.01) |

(52) U.S. Cl.

CPC ..... *A43B 7/14* (2013.01); *A43B 3/34* (2022.01); *A43B 7/02* (2013.01); *A43B 7/083* (2022.01); *A43B 23/0285* (2013.01)

(58) Field of Classification Search

CPC ..... A43B 7/02; A43B 7/005; A43B 23/0285; A43B 7/083; A43B 3/34; A43B 3/35; A43B 3/38; A43B 3/40

USPC ..... 36/50.1, 2.6, 3 R

See application file for complete search history.

(56) References Cited

U.S. PATENT DOCUMENTS

| | | | | |
|---|---|---|---|---|
| 4,649,656 A * | 3/1987 | Cox | A43B 5/08 | 36/114 |
| 4,771,394 A * | 9/1988 | Cavanagh | G01C 22/006 | 482/901 |
| 4,800,867 A * | 1/1989 | Owens | A61F 7/02 | 36/2.6 |

(Continued)

OTHER PUBLICATIONS

Oct. 17, 2024 (WO) International Search Report and Written Opinion—App PCT/US2024/039777, 9 pages.

*Primary Examiner* — Marie D Bays

(74) *Attorney, Agent, or Firm* — Banner & Witcoff, Ltd.

(57) ABSTRACT

Footwear components apply heat, cooling, and/or pressure to a wearer's foot/leg/ankle. Such footwear includes one or more of: (a) an interior upper layer formed from one or more interior upper component parts; (b) an exterior upper layer formed from one or more exterior upper component parts and engaged with the interior upper layer, wherein the interior and exterior upper layers define an ankle-receiving chamber of the footwear upper; (c) a fluid-filled bladder system including a first fluid chamber located between the interior and exterior upper layers; (d) a heating and/or cooling system having at least a portion engaged with the first fluid chamber; (e) a fluid source component (e.g., pump, compressor, etc.) in fluid communication with the first fluid chamber and configured to supply fluid to the first fluid chamber; (f) a power source; and/or (g) a securing system for releasably securing the footwear upper to a wearer's foot/leg/ankle.

20 Claims, 20 Drawing Sheets

(56) References Cited

U.S. PATENT DOCUMENTS 5,367,788 A * 11/1994 Chen ..... A43B 3/34 36/2.6
6,195,921 B1 * 3/2001 Truong ..... A43B 3/00 36/137
6,230,501 B1 * 5/2001 Bailey, Sr. ..... B60N 2/5685 62/51.1
7,186,957 B2 * 3/2007 Martin ..... A43B 3/34 62/3.3
7,219,449 B1 * 5/2007 Hoffberg ..... A43B 1/0054 36/88
9,107,468 B1 * 8/2015 Xiong ..... A43B 3/35
11,653,712 B2 5/2023 Costa et al.
2006/0005432 A1 * 1/2006 Kassai ..... A43B 11/00 36/138
2007/0294919 A1 * 12/2007 Evans ..... A43B 3/30 36/50.1
2008/0209770 A1 * 9/2008 Boone ..... A43B 3/00 36/35 B
2011/0107771 A1 * 5/2011 Crist ..... A43B 3/355 36/83
2011/0247238 A1 * 10/2011 Chestnut ..... A43B 3/06 36/105
2012/0186101 A1 * 7/2012 Sanchez ..... A43B 7/142 36/43
2014/0259790 A1 * 9/2014 Faggin ..... A43B 7/005 36/83
2015/0289595 A1 * 10/2015 Rushbrook ..... A43B 23/0295 36/50.1
2017/0360155 A1 12/2017 Leary et al.
2020/0170351 A1 * 6/2020 Donohoe ..... B65H 75/4486
2021/0186142 A1 * 6/2021 Chiu ..... A43B 7/06
2022/0000213 A1 * 1/2022 Little ..... H04R 1/02
2023/0157418 A1 * 5/2023 Cook ..... A43B 1/0081 36/50.1
2023/0172315 A1 6/2023 Case et al.

* cited by examiner

FOOTWEAR STRUCTURES PROVIDING COMPRESSION AND THERMAL TREATMENT

RELATED APPLICATION DATA

This application is a U.S. Non-Provisional Patent Application based on and claiming priority to U.S. Provisional Patent Appln. No. 63/529,402 filed Jul. 28, 2023 and entitled "Footwear Structures Providing Compression and Thermal Treatment." U.S. Provisional Patent Appln. No. 63/529,402 is entirely incorporated herein by reference.

FIELD OF THE INVENTION

The present technology relates to articles of footwear and/or footwear uppers that apply heat, cooling, and/or pressure to a wearer's foot, leg, and/or ankle. Additional aspects of this technology relate to methods of making and/or using such footwear products.

BACKGROUND

Proper care of the feet and/or ankles can help improve an athlete's performance and help the athlete recover. Such care includes proper stretching, warm-up, and cool-down activities. But many athletes fail to take proper care for a variety of reasons, e.g., lack of training, uncertainty of techniques, inconvenience, etc.

SUMMARY

This Summary is provided to introduce some general concepts relating to this technology in a simplified form that are further described below in the Detailed Description. This Summary is not intended to identify key features or essential features of the invention.

Aspects of this technology relate to articles of footwear and/or footwear uppers that apply heat, cooling, and/or pressure to a wearer's foot, leg, and/or ankle. Additional aspects of this technology relate to methods of making and/or using such articles of footwear and/or footwear uppers.

As some more specific examples, aspects of this technology relate to footwear uppers that include one or more of: (a) an interior upper layer formed from one or more interior upper component parts; (b) an exterior upper layer formed from one or more exterior upper component parts and engaged with the interior upper layer, wherein the interior upper layer and the exterior upper layer define an ankle-receiving chamber of the footwear upper; (c) a fluid-filled bladder system including a first fluid chamber located between the interior upper layer and the exterior upper layer; (d) a heating system having at least a portion engaged with the first fluid chamber; (c) a fluid source component in fluid communication with the first fluid chamber and configured to supply fluid to the first fluid chamber; (f) a power source for supplying power to at least the heating system; and/or (g) a securing system for releasably securing the footwear upper to a wearer's foot, leg, and/or ankle. Additional aspects of this technology relate to articles of footwear that include footwear uppers as described above engaged with a sole structure.

Additional aspects of this technology relate to sole structures for articles of footwear that include: (a) a sole component, wherein a recess is defined in the sole component, wherein one or more vents are defined in a material of the sole component, the one or more vents including: (i) one or more through hole openings extending from the recess to an exterior surface of the sole component (e.g., in the top surface of the recess) and/or (ii) one or more elongated channels defined in a material of the sole component and extending from the recess to the exterior surface of the sole component; and (b) a power source at least partially received in the recess. Additional aspects of this technology relate to articles of footwear that include sole structures as described above engaged with a footwear upper.

Still additional aspects of this technology relate to articles of footwear that include footwear uppers as described above engaged with sole structures as described above.

Additional aspects of this technology relate to articles of footwear that include: (A) a sole structure; (B) a footwear upper engaged with the sole structure, wherein the footwear upper includes: (i) a fluid-filled bladder system including a first fluid chamber zone and a second fluid chamber zone, and (ii) a securing system for releasably securing the footwear upper to a wearer's foot, leg, and/or ankle; (C) a fluid transfer system configured to move fluid: (i) into and out of the first fluid chamber zone, (ii) into and out of the second fluid chamber zone, and (iii) in a manner to cyclically and sequentially increase pressure and decrease pressure in each of the first fluid chamber zone and the second fluid chamber zone; and (D) a power source for supplying power to the fluid transfer system.

Additional aspects of this technology relate to footwear systems for applying cooling, heat, and/or pressure to a wearer's foot, leg, and/or ankle. Such footwear systems may include footwear uppers of the various types described above and/or footwear sole structures of the various types described above. The footwear systems further may include an electronic control system engaged with at least one of the footwear upper and the sole structure, the electronic control system being configured to control the cooling, heat, and/or pressure applied to the wearer's foot.

Still additional aspects of this technology relate to methods of using footwear uppers, sole structures, articles of footwear, and/or footwear systems, e.g., of the types described above, for treating a foot, ankle, and/or leg of a wearer. Such methods may include: (a) placing a foot in an interior chamber of a footwear upper, article of footwear, and/or footwear system, e.g., of the types described above; (b) securing the footwear upper to the foot, ankle, and/or leg using a securing system; (c) powering a heating system to apply heat to the foot, ankle, and/or leg; (d) powering a cooling system to apply cooling to the foot, ankle, and/or leg; and (e) powering a fluid source component (e.g., a pump, a compressor, etc.) to change fluid pressure in the fluid-filled bladder system to thereby apply compressive force to the foot, ankle, and/or leg.

BRIEF DESCRIPTION OF THE DRAWINGS

The foregoing Summary, as well as the following Detailed Description, will be better understood when considered in conjunction with the accompanying drawings in which like reference numerals refer to the same or similar elements in all of the various views in which that reference number appears.

DETAILED DESCRIPTION

Figure 1:
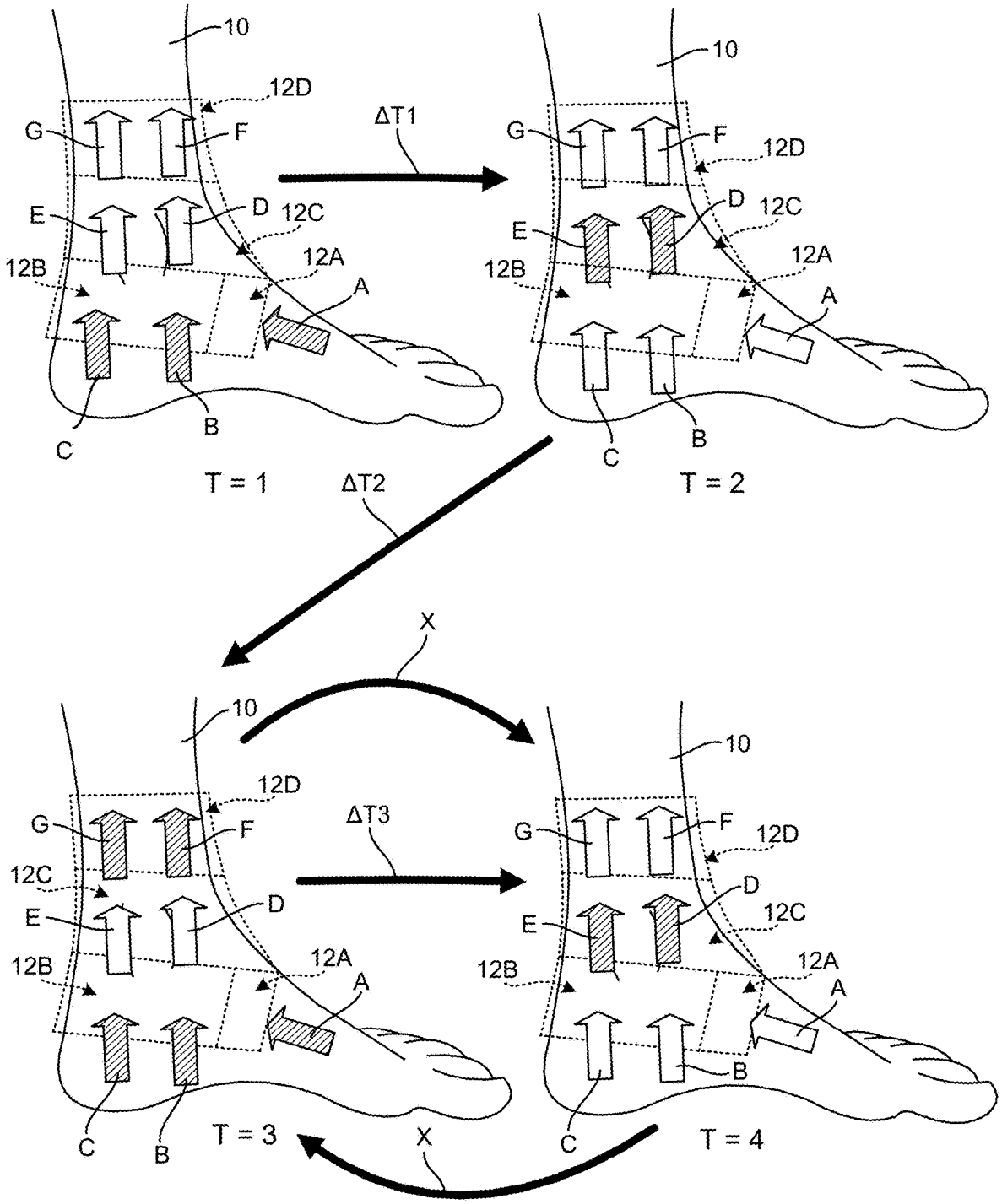
FIG. 1 illustrates various features of cyclic pressurization for foot compressive force treatments in accordance with at least some examples of this technology.

In the following description of various examples of footwear structures and components according to the present technology, reference is made to the accompanying drawings, which form a part hereof, and in which are shown by way of illustration various example structures and environments in which aspects of the present technology may be practiced. It is to be understood that other structures and environments may be utilized and that structural and functional modifications may be made to the specifically described structures and methods without departing from the scope of the present disclosure.

"Footwear," as that term is used herein, means any type of wearing apparel for the feet, and this term includes, but is not limited to: all types of shoes, boots, sneakers, sandals, thongs, flip-flops, mules, scuffs, slippers, sport-specific shoes (such as golf shoes, tennis shoes, baseball cleats, soccer or football cleats, ski boots, basketball shoes, cross training shoes, dance shoes, etc.), and the like.

The term "rearward" as used herein means at or toward the heel region of the article of footwear (or component thereof), and the term "forward" as used herein means at or toward a forefoot or forward toe region of the article of footwear (or component thereof). Unless otherwise defined, the terms "heel area" or "heel region" refer to a rearmost ⅓ of an article of footwear and/or footwear component; the terms "forefoot area" or "forefoot region" refer to a forwardmost ⅓ of an article of footwear and/or footwear component; and the terms "midfoot area," "midfoot region," or "arch region" refer to a central ⅓ of an article of footwear and/or footwear component (e.g., located between the heel area and the forefoot area). Also, the term "lateral" means the "little toe" side or outside area of an article of footwear or component thereof (e.g., an upper, a sole structure, etc.), and the term "medial" means the "big toe" side or inside area of an article of footwear or component thereof (e.g., an upper, a sole structure, etc.).

This application describes that footwear upper components and/or bladder components may be configured and arranged to "wrap" around a wearer's ankle and/or leg. The term "wrap" (and variation thereof) as used herein in this context, means that the wrapping component extends around at least 90% of a circumference of the body part being "wrapped." In some examples of this technology, a "wrapped" ankle or leg portion will have at least 90% of its circumference wrapped, e.g., from a forward lateral side, around a rear, and to a forward medial side, potentially leaving a small gap (10% of the circumference or less) at a forward portion of the ankle or leg. The small gap may be present, for example, due to the securing system, due to a large leg size, due to the design of the securing system and/or straps, etc. The term "completely wrapped" (and variations thereof) means that the wrapping component extends around 100% of the circumference of the body part being "wrapped." In other examples of this technology, however, the footwear upper components and/or bladder components may be configured and arranged to at least partially extend around a body part (e.g., extend around at least a part of a wearer's ankle and/or leg). As some more specific examples, the footwear upper components and/or bladder components may be configured and arranged to extend around at least 75%, at least 80%, or even at least 85% of a circumference of the body part (e.g., around a wearer's ankle and/or leg) (and, in some examples, one or more strap members or other securing devices may extend around the remainder of the circumference to attach the footwear upper components and/or bladder components to the wearer's body part (e.g., around a wearer's ankle and/or leg)).

This application and/or its claims may use the terms, e.g., "first," "second," "third," and the like, to identify certain components and/or features relating to this technology. These terms are used merely for convenience, e.g., to assist in maintaining a distinction between components and/or features of a specific structure. Use of these terms should not be construed as requiring a specific order or arrangement of the components and/or features being discussed. Also, use of these specific terms in the specification for a specific structure does not require that the same term be used in the claims to refer to the same structure (e.g., a component or feature referred to as the "third" in the specification may correspond to any numerical adjective used for that component or feature in the claims).

Given the general description of features, aspects, structures, processes, and arrangements according to certain examples of this technology provided above, a more detailed description of specific example footwear uppers, sole structures, articles of footwear, footwear systems, and methods in accordance with this technology follows. Where the same reference number appears in multiple figures, the same or similar part is being referenced, and at least some of the overlapping description of that part may be omitted.

As mentioned above, aspects of this technology relate to articles of footwear, footwear uppers, systems, and methods for applying compressive force treatments (e.g., including massage treatments) and/or thermal treatments to a heel, ankle, and/or leg region of a user. As will be explained in more detail below, the compressive forces may be applied by increasing fluid pressure in a fluid-filled bladder system (e.g., bladder system 600 described below) included as part of a footwear upper (e.g., footwear upper 102). In accordance with some aspects of this technology, compressive forces may be applied to the wearer through two or more zones of the bladder system in a cyclical and/or pulsating manner. As some more specific examples, based on the pressurization and deflation of various different bladder chambers of a fluid-filled bladder system, the wearer may feel that the compressive forces move rearward and/or upward along the heel, ankle, and/or leg regions, e.g., from a midfoot and/or instep region of the foot, up the ankle, up the leg, and to the top of the article of footwear. The cyclical and/or pulsating application of compressive forces may help push the wearer's blood rearward and/or upward along the wearer's heel, ankle, and/or leg regions, e.g., from a midfoot and/or instep region of the foot, up the ankle, and up the leg, thereby helping improve blood flow and the wearer's recovery and healing.

FIG. 1 schematically illustrates examples of processes in accordance with at least some examples of this technology having this type of cyclical and/or pulsating compressive force application. FIG. 1 illustrates locations of various zones of a bladder system (which may be provided in a footwear upper and article of footwear placed on a wearer's foot and/or leg 10). While any number of separated zones may be provided (e.g., two or more) and many different specific arrangements of the zones may be provided, this illustrated example includes four zones: zone 12A (located at the instep region at the forwardmost extent of the bladder system), zone 12B (located at the lower heel/ankle region), zone 12C (located at the ankle region), and zone 12D (located at the lower leg region (e.g., including all or part of the Achilles tendon of the wearer's leg 10). The zones 12A-12D may represent separate bladder chambers of the bladder systems described in more detail below, or two or more of the zones 12A-12D may be provided within a single bladder chamber of the bladder systems described below (optionally with fluid flow within the single bladder chamber controlled, e.g., based on the shape of the bladder chamber, the shapes of baffles or internal bonds within the bladder chamber, etc.).

The top left of FIG. 1 shows this example bladder system when a compressive force treatment is initiated (time T=1). In this example, at the start, fluid is added to zone 12A to increase the fluid pressure within this zone 12A. Zone 12A may include its fluid inlet toward its forward end (e.g., in the instep region) so that the fluid in zone 12A moves from zone 12A's forward end to its rear end (as shown by pressure arrow A). In FIG. 1, the hatched pressure arrows are intended to relate to bladder zones having increased (or increasing) pressure and the unhatched pressure arrows are intended to relate to bladder zones having decreased (or decreasing) pressure. In some examples, internal bonds or baffles within zone 12A may help the fluid flow move progressively from the forward inlet region in the rearward direction.

At this same time (or perhaps somewhat later), fluid is added to zone 12B to increase the fluid pressure within this zone 12B. Zone 12B may include its fluid inlet toward its bottom end (e.g., at the lower ankle or heel region) so that the fluid in zone 12B moves from zone 12B's bottom end to its top end (as shown by hatched pressure arrows B and C). In some examples, internal bonds or baffles within zone 12B may help the fluid flow move progressively from the bottom inlet region in the upward direction. At this time T=1, zones 12C and 12D are in a low pressure condition or may be unpressurized, e.g., as shown by unhatched pressure arrows D, E, F, and G in the top left of FIG. 1.

The top right of FIG. 1 shows this example system at time T=2, some time after T=1 (ΔT1). At this time, the compressive forces applied by fluid in the bladder system have moved rearward through zone 12A and upward through zone 12B. During this time T=2, the bladder chamber (or bladder chamber portion) of zone 12C increases in pressure (shown by hatched pressure arrows D and E at the top right of FIG. 1). Zone 12C may include its fluid inlet toward its bottom end (e.g., at the mid-ankle region) so that the fluid in zone 12C moves from zone 12C's bottom end to its top end (as shown by hatched pressure arrows D and E). In some examples, internal bonds or baffles within zone 12C may help the fluid flow move progressively from the bottom inlet region in the upward direction. Additionally, during this time T=2, the bladder chamber(s) (or bladder chamber portion(s)) of zones 12A and 12B decrease in pressure (shown by unhatched pressure arrows A, B, and C at the top right of FIG. 1).

The bottom left of FIG. 1 shows this example system at time T=3, some time after T=2 (ΔT2). At this time, the compressive forces applied by fluid in the bladder system have moved upward through zone 12C. During this time T=3, the bladder chamber (or bladder chamber portion) of zone 12D increases in pressure (shown by hatched pressure arrows F and G in the bottom left of FIG. 1). Zone 12D may include its fluid inlet toward its bottom end (e.g., at the mid-ankle region or upper ankle region) so that the fluid in zone 12D moves from zone 12D's bottom end to its top end (as shown by hatched pressure arrows F and G). In some examples, internal bonds or baffles within zone 12D may help the fluid flow move progressively from the bottom inlet region in the upward direction. Additionally, during this time T=3: (i) the bladder chamber (or bladder chamber portion) of zone 12C decreases in pressure (shown by unhatched pressure arrows D and E at the bottom left of FIG. 1) and (ii) the bladder chamber(s) (or bladder chamber portion(s)) of zones 12A and 12B increase in pressure (shown by hatched pressure arrows A, B, and C at the bottom left of FIG. 1).

The bottom right of FIG. 1 shows this example system at time T=4, some time after T=3 (ΔT3). At this time, the compressive forces applied by fluid in the bladder system have moved upward through zone 12D. During this time T=4: (i) the bladder chamber (or bladder chamber portion) of zone 12D decreases in pressure (shown by unhatched pressure arrows F and G at the bottom right of FIG. 1); (ii) the bladder chamber (or bladder chamber portion) of zone 12C increases in pressure (shown by hatched pressure arrows D and E at the bottom right of FIG. 1); and (iii) the bladder chamber(s) (or bladder chamber portion(s)) of zones 12A and 12B decrease in pressure (shown by unhatched pressure arrows A, B, and C at the bottom right of FIG. 1).

After these initial start up steps, the bladder systems may cycle any desired number of times between the configurations shown at T=4 and T=3, e.g., as shown by cycle arrows X in FIG. 1. This action repeatedly pressurizes and depressurizes zones 12A-12D to progressively move compressive forces rearwardly and upwardly, e.g., from zone 12A to zone 12D, and improve blood movement and flow through these zones. The cyclical and/or pulsating application of compressive forces may help push the wearer's blood rearward and/or upward along the wearer's heel, ankle, and/or leg regions, e.g., from a midfoot and/or instep region of the foot, up the ankle, and up the leg, helping improve the wearer's recovery and healing.

While the explanation of FIG. 1 includes four zones 12A-12D, similar cyclical and/or pulsating application of compressive forces may be applied in any desired number of zones (e.g., two or more zones) in other specific examples of this technology. Also, while the above description of FIG. 1 describes various different actions taking place at times T=1 through T=4, when multiple actions are described as occurring at a specific time, those actions need not occur at exactly the same moment. Rather, the various actions described as taking place within time T=1, within time T=2, within time T=3, and/or within time T=4 may take place at different moments in some examples of this technology (e.g., in a sequential manner to support the desired blood flow directional effect).

In view of the above general description in association with FIG. 1, more specific examples of footwear uppers, articles of footwear, systems, and methods for performing these (and potentially other) functions are described below in conjunction with FIGS. 2A-12.

Figure 2A:
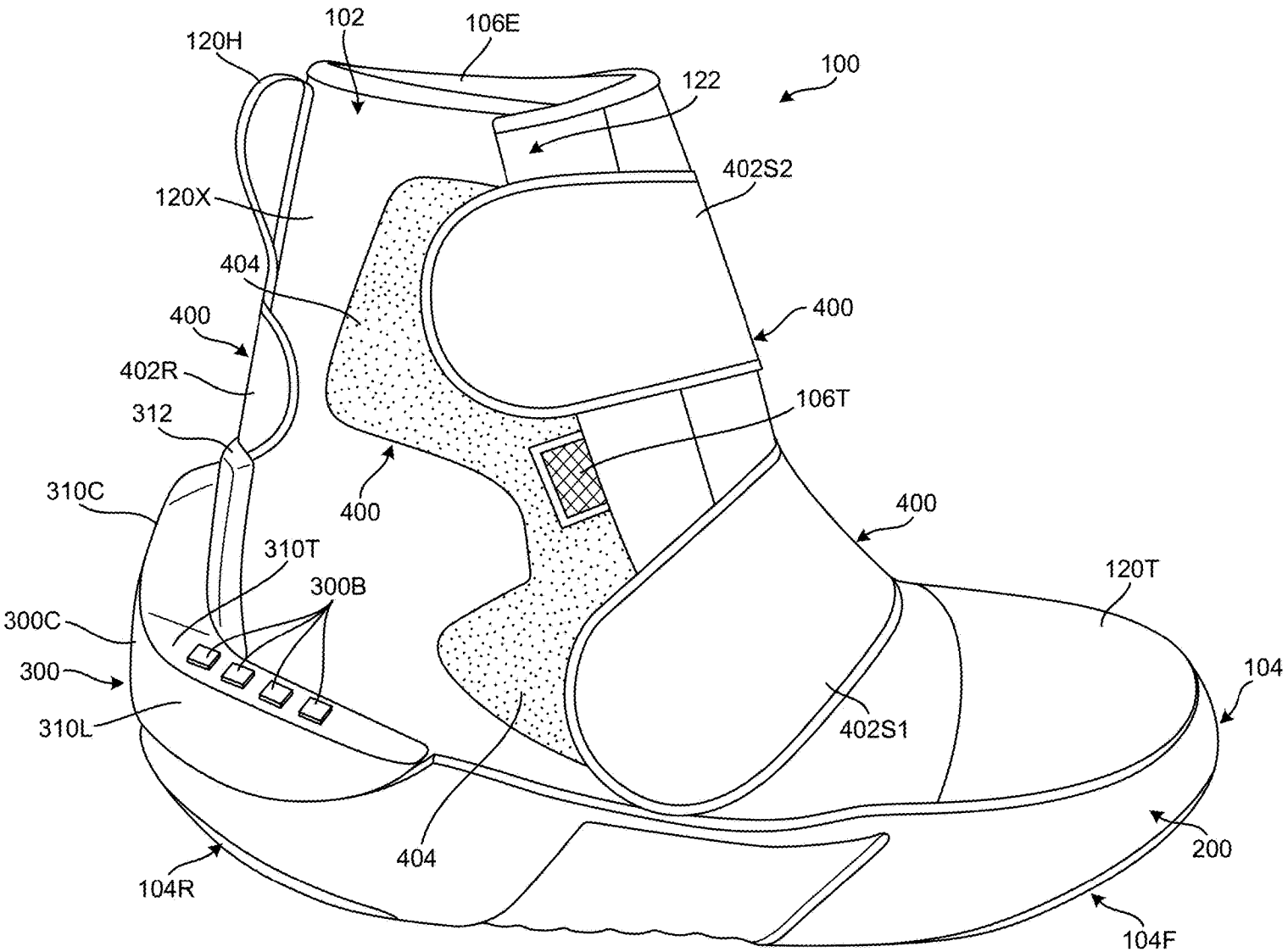
FIGS. 2A-2E provide various views of an article of footwear in accordance with some aspects of this technology.
Figure 2B:
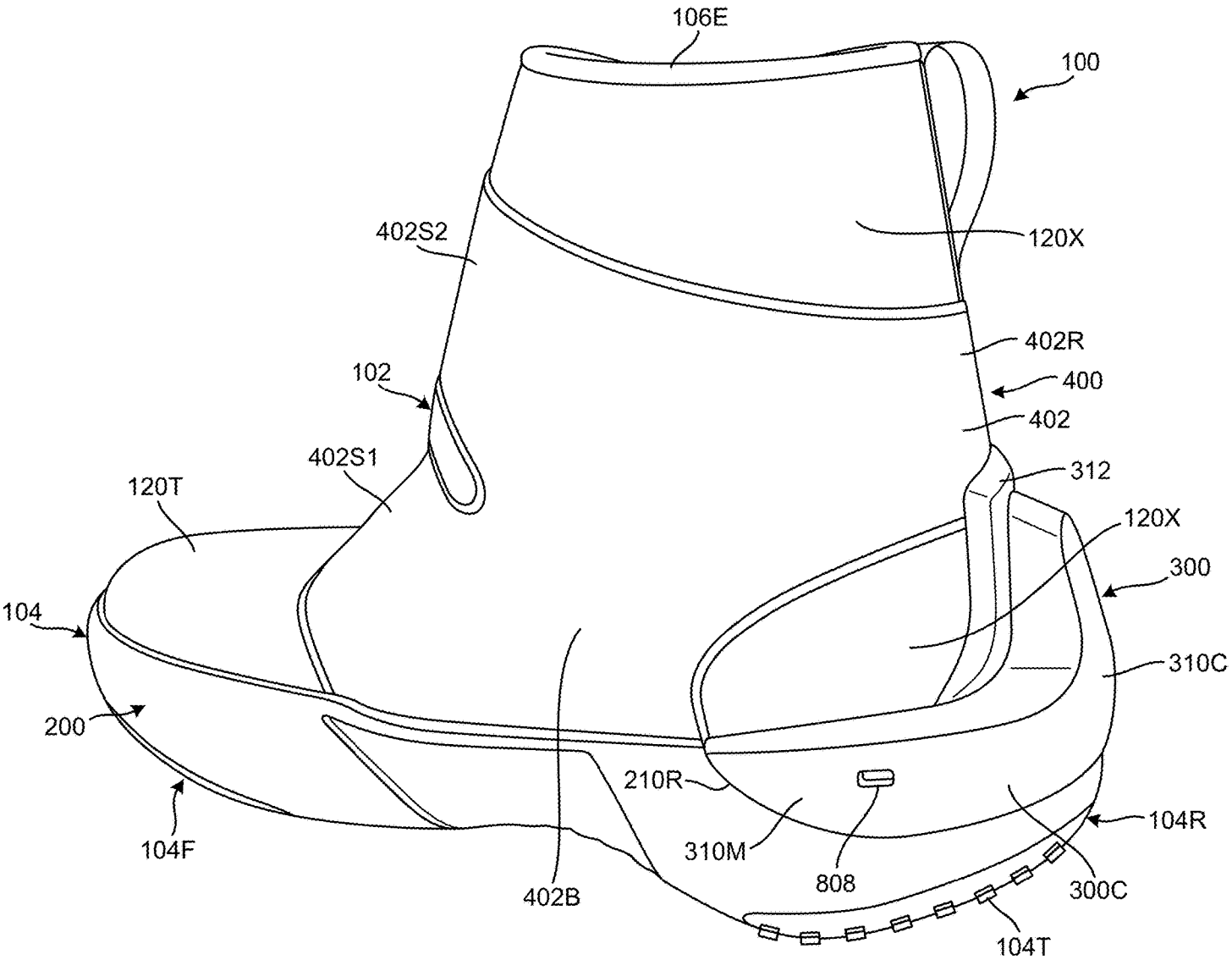
Figure 2D:
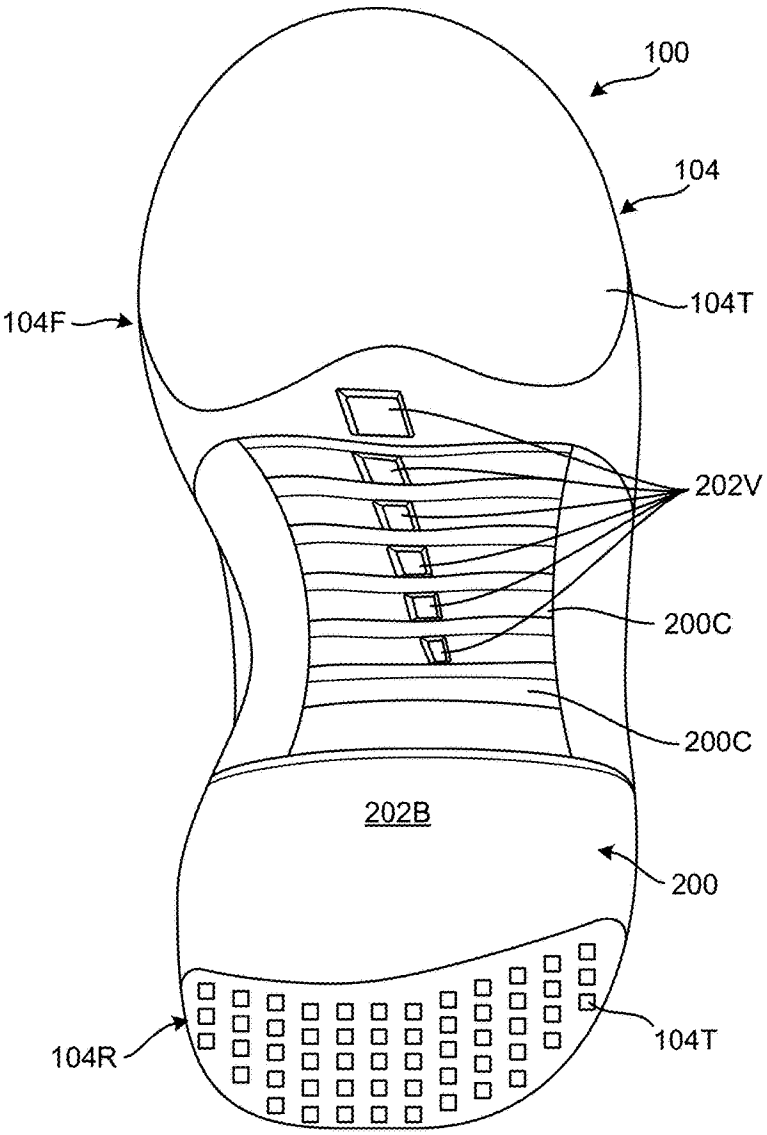
Figure 2C:
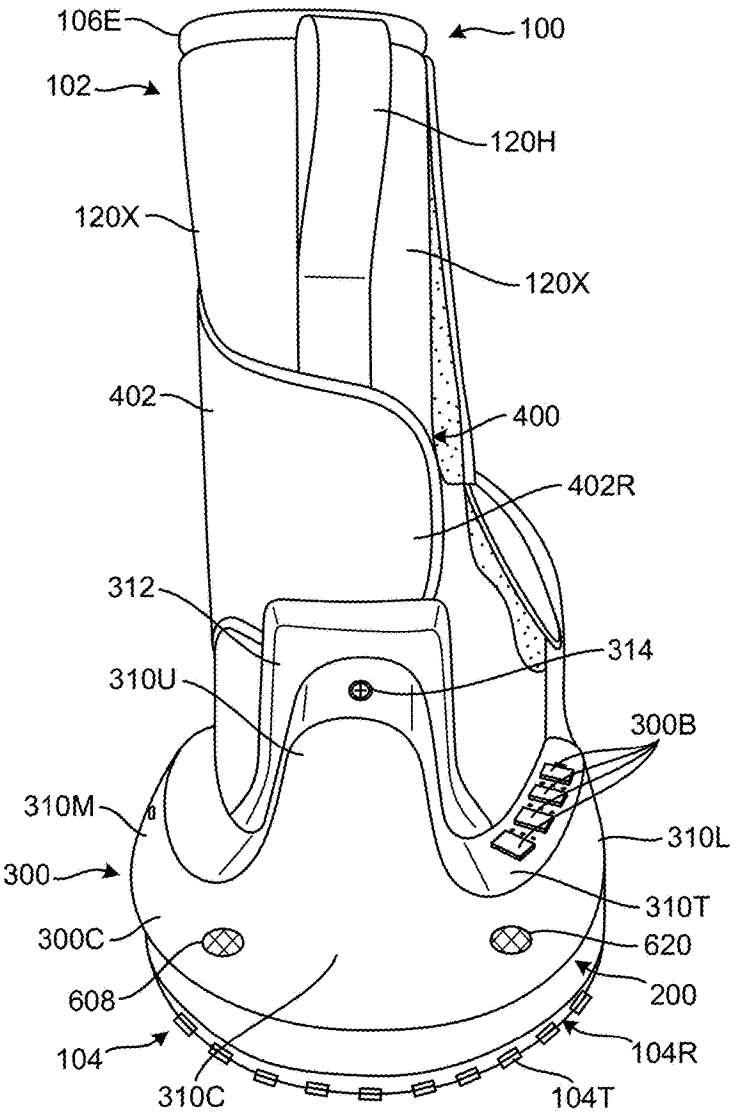
Figure 2E:
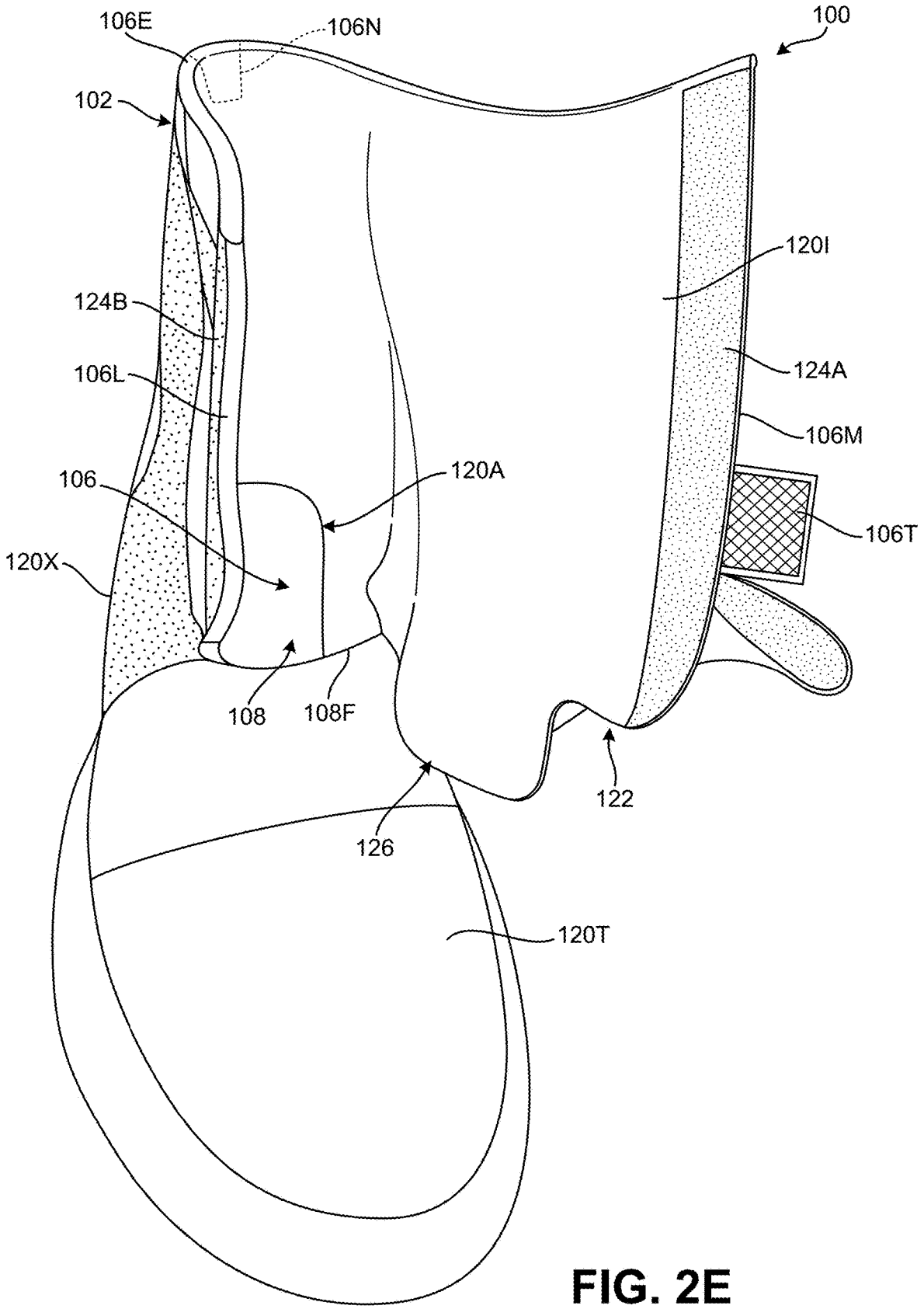

FIGS. 2A-2E provide various views of an article of footwear 100 (and also a footwear system) in accordance with some aspects of this technology. More specifically, FIG. 2A provides a lateral side view of the article of footwear 100; FIG. 2B provides a rear, medial, perspective view; FIG. 2C provides a rear view; FIG. 2D provides a bottom view; and FIG. 2E provides a front perspective view with the footwear upper 102 in a foot insertion and/or removal configuration. In addition to the footwear upper 102 mentioned above, articles of footwear 100 in accordance with at least some aspects of this technology include a sole structure 104 engaged with the footwear upper 102 (e.g., using one or more of adhesives, stitching, mechanical connectors, etc.). Example features of footwear uppers 102 and sole structures 104 in accordance with aspects of this technology will be described in more detail below.

The footwear upper 102 of this illustrated example defines a foot-receiving chamber 106 that sized and shaped receive a wearer's foot, leg, and/or ankle. This example footwear upper 102 extends upward from the foot-containing region at least to contain a wearer's ankle. In the illustrated example, the footwear upper 102 extends upward such that the top edge 106E of the footwear upper 102 would be located above a wearer's ankle (and thus the footwear upper 102 includes an ankle-containing region and/or an Achilles tendon containing region). In some examples of this technology, the footwear upper 102 may generally extend upward to a height of conventional "hightop" footwear or even higher. As some more specific examples, the footwear upper 102 may extend at least 5 cm above an ankle-containing level of the footwear upper 102 (the "ankle-containing level" of a footwear upper 102 may be defined as the portion of the footwear upper 102 that covers the medial malleolus and lateral malleolus bones of a typical wearer). As some additional examples, the footwear upper 102 may extend at least 8 cm, at least 10 cm, or even at least 12 cm above the ankle-containing level. Additionally or alternatively, the top edge 106E may include a central, rear heel recess or notch (an example is shown in broken lines 106N in FIG. 2E), e.g., to provide a more comfortable fit.

The footwear upper 102 is engaged with sole structure 104. The sole structure 104 of this article of footwear 100 is configured to provide a surface suitable for many types of ambulatory activities, e.g., including walking, warm-up, cool-down, stretching, jogging, etc. This illustrated example sole structure 104 includes a midsole component 200 that provides comfort underfoot and attenuates impact forces (e.g., when moving). This illustrated midsole component 200 includes one or more polymeric foam components. Additionally or alternatively, if desired, the midsole component 200 (or another component of the sole structure 104) may include one or more of: one or more fluid-filled bladders and/or one or more mechanical shock absorbing components, etc. As shown in FIG. 2D, this sole structure 104 further includes a rearward outsole component 104R and a forward outsole component 104F (leaving a bottom surface 202B of the midsole component 200 exposed at the bottom of the overall sole structure 104 at least in the midfoot region). The outsole components 104R, 104F include traction elements 104T formed as a matrix of raised nubs, although any desired type of traction element structures and/or arrangements may be provided in other specific examples of this technology. The outsole components 104R, 104F are suitable for contacting the ground during use (e.g., have sufficient hardness, durability, abrasion resistance, etc. to engage a ground surface, such as a floor, grass, concrete, asphalt, etc.). The bottom surface 202B of the midsole component 200 also may include traction elements and/or flex promoting structures (e.g., note the transverse longitudinal channels 200C shown in FIG. 2D). In other sole structures 104 in accordance with other examples of this technology, the bottom surface 202B of the midsole component 200 may be covered by one or more outsole components. A wide variety of sole structures may be used in other examples of this technology.

While two separated outsole components 104R, 104F are shown in this specific example sole structure 104, more or fewer outsole components could be provided (including no outsole components). Further, any outsole components present may have any desired size, shape, and/or arrangement in other specific examples of this technology. The outsole component(s) 104R, 104F, when present, may constitute stock fit parts, e.g., that fit into shallow recesses formed in the bottom surface 202B of the midsole component 200 (and may be cemented in place). The outsole component(s) 104R, 104F may be formed from any desired material, including materials conventionally known and used for outsoles in the footwear arts (e.g., rubber materials, thermoplastic polymer materials, elastomeric materials, etc.). One or more outsole components also could be provided to completely cover the bottom surface 202B of the midsole component 200, in some examples of this technology.

As noted above, articles of footwear 100 and overall footwear systems in accordance with aspects of this technology include features for applying heat and/or compressive force to a wearer's foot, ankle and/or leg. While the heat and pressure applying systems are not generally visible in FIGS. 2A-2E, FIGS. 2A-2C illustrate that this example article of footwear 100 (and footwear system) includes a housing 300 for holding one or more electronic components and other components provided with this article of footwear 100 (and footwear system). These additional components include at least portions of the systems and components for applying heat and/or compressive force to the wearer's foot, leg, and/or ankle. As will be explained in more detail below, the housing 300 may be formed from multiple component parts, e.g., a dock part (attached to the footwear upper 102 and/or sole structure 104) and a cover part (e.g., which may snap fit or otherwise attach to the dock part), and an interior space may be defined by these multiple component parts (e.g., between the dock part and the cover part). The housing 300 may house (e.g., within its interior space) at least portions of one or more of: an electronic control system for controlling functions of the article of footwear 100 or footwear system; a fluid source component (e.g., a pump or compressor for supplying air to other footwear component parts, a fluid reservoir component, etc.); a heating system; an input system; an antenna; one or more microprocessors; one or more fluid lines; wiring from one or more of the noted components or systems; etc.

This example housing 300 fits around and is engaged with a rear heel region of the footwear upper 102. While other shapes are possible, the housing 300 of this example includes a lateral arm 310L, a medial arm 310M, and a rear central portion 310C connecting the lateral arm 310L and medial arm 310M. Thus, the housing 300 may be C-shaped when viewed from above. The rear central portion 310C of this illustrated example housing 300 further includes an upwardly extending arm 310U that extends upward above top surfaces of the lateral arm 310L and medial arm 310M. As further shown in FIGS. 2A-2C, in this specific example article of footwear 100 structure, at least the upwardly extending arm 310U is separated from the main footwear upper 102 components by a moderator component 312. The moderator component 312 may include a foam pad or other structure located between at least a portion of the housing 300 (e.g., the upwardly extending arm 310U) and the exterior-most surface or layer of the footwear upper 102. The moderator component 312 moderates the feel of the housing 300 against the wearer's foot, leg, and/or ankle. In addition to its location adjacent the upwardly extending arm 310U, the moderator component 312 may extend to separate all or at least some portion(s) of the medial arm 310M, the lateral arm 310L, and/or the rear central portion 310C of the housing 310 from the exterior surface or layer of the footwear upper 102. The moderator component 312 also may be formed from multiple moderator component parts (e.g., multiple foam parts).

The housing 300 of this example includes input buttons 300B (hard or physical buttons) used to activate and/or control various functions of the article of footwear 100 and footwear system (e.g., one or more of the heating system, the fluid source component, and/or the power source, as will be described in more detail below). While four discrete buttons 300B are shown in FIGS. 2A and 2C, more or fewer buttons may be provided (including no hard or physical buttons) in other specific examples of this technology. Also, while FIGS. 2A and 2C show the buttons 300B located on a top surface 310T of lateral arm 310L of the housing 300, one or more buttons 300B could be provided at other locations on the housing 300 and/or at other locations on the overall article of footwear 100 in other specific examples of this technology (e.g., on the medial arm 310M, on the rear central portion 310C, etc.). Additionally or alternatively, other types of buttons, switches, and/or input devices may be provided on the housing 300 and/or on the overall article of footwear 100 in other specific examples of this technology. For example, in addition or as an alternative to the physical or hard buttons 300B shown in FIGS. 2A and 2C, if desired, one or more input buttons 300B may be provided as "soft buttons," e.g., using a touch screen or touch panel affixed to the article of footwear 100 (e.g., affixed with one or more of housing 300, footwear upper 102, sole structure 104, etc.). The buttons 300B of the example article of footwear 100 of FIGS. 2A-2E may have any of the features, functions, options, and/or alternatives described in more detail below in conjunction with FIG. 9C.

FIG. 2E shows this example footwear upper 102 in an open configuration (while FIGS. 2A-2C show the footwear upper 102 in a closed configuration). As shown in FIGS. 2A-2C and 2E, at least the ankle-containing region of the footwear upper 102 includes an interior upper layer 1201 and an exterior upper layer 120X engaged with and located opposite the interior upper layer 1201. The interior upper layer 1201 may be formed by any number (one or more) of interior upper component parts (e.g., one or more fabric component parts), such as one or more interior lining layer parts conventionally used in footwear construction. The exterior upper layer 120X also may be formed by any number (one or more) of exterior upper component parts (e.g., one or more fabric component parts), including component parts conventionally known and used in footwear construction. While other arrangements are possible, in this illustrate example, the interior upper layer 1201 and the exterior upper layer 120X are engaged together by one or more sewn seams (e.g., extending around a perimeter of the combined upper components). Additionally or alternatively, the interior upper layer 1201 and the exterior upper layer 120X may be joined in other manners, such as via adhesives, via fasteners, etc.

As evident from FIG. 2E, the interior upper layer 1201 and the exterior upper layer 120X define an ankle-containing chamber 120A of the footwear upper 102 (e.g., including at least a lateral side ankle-containing region, a rear ankle-containing region, and a medial side ankle-containing region). The interior upper layer 1201 and the exterior upper layer 120X may be fixed together, at least at the ankle-containing chamber 120A, to form an interior pocket or chamber between the interior upper layer 1201 and the exterior upper layer 120X. At least a portion of a heating system and/or a compressive force applying system (e.g., including a fluid-filled bladder system) will be located within this interior pocket or chamber. For reasons that will become more apparent from the discussion below, the interior upper layer 1201 and the exterior upper layer 120X may be fixed together relatively loosely at least at the interior pocket or chamber, e.g., so that the interior upper layer 120I can move relatively freely with respect to the exterior upper layer 120X at least at the ankle-containing chamber 120A.

Additionally or alternatively, in at least some examples of this technology, the interior upper layer 1201 may have a first stretchability and the exterior upper layer 120X may have a second stretchability, wherein the first stretchability is greater than the second stretchability. In other words, in at least some examples of this technology, the interior upper layer 1201 may be more "stretchable" than the exterior upper layer 120X. Still additionally or alternatively, in at least some examples of this technology, the interior upper layer 1201 may have a first stiffness and the exterior upper layer 120X may have a second stiffness, wherein the second stiffness is greater than the first stiffness. In other words, in at least some examples of this technology, the exterior upper layer 120X may be made from "stiffer" material than the interior upper layer 1201. As will become more apparent from the discussion below, these features, when present, may help the footwear upper 102 displace inward when the fluid-filled bladder system 600 is pressurized to apply compressive forces to a wearer's foot, ankle, and/or leg and/or to provide a conforming fit to a wearer's foot, ankle, and/or leg.

In at least some examples of this technology, the interior upper layer 1201 may have at least 10% greater "stretchability" than the exterior upper layer 120X, and in some examples, at least 25% greater, 35% greater, 50% greater, 75% greater, or even 100% greater (e.g., as measured by standard fabric stretchability measurement standards, such as ASTM-D3107 and/or ASTM-D2594-99*a* and/or using conventional fabric stretchability measurement equipment and/or techniques). Additionally or alternatively, in at least some examples of this technology, the exterior upper layer 120X may have at least 10% greater "stiffness" than the interior upper layer 1201, and in some examples, at least 25% greater, 35% greater, 50% greater, 75% greater, or even 100% greater (e.g., as measured by standard fabric stiffness measurement standards, such as ASTM-D1388 and/or ASTM-D4032 and/or using conventional fabric stiffness measurement equipment and/or techniques).

FIG. 2E further illustrates that this example footwear upper 102 defines a foot-receiving opening at the top (around top edge 106E) and forward instep area of the footwear upper 102. In addition to the top edge 106E, the foot-receiving opening of this example footwear upper 102 includes a first side edge 106L (a lateral side edge in this illustrated example) that extends downward from the top edge 106E. Additionally, the top edge 106E extends to a securing flap 122 located on the opposite side of the top edge 106E from first side edge 106L. The securing flap 122 ends at a second side edge 106M that extends downward from the top edge 106E. A fastener system 124A provided along the second side edge 106M (e.g., on interior upper layer 1201) releasably engages a complementary fastener system 124B provided on the first side edge 106L (e.g., on the exterior upper layer 120X) to releasably engage the securing flap 122 around a wearer's foot, ankle, and/or leg (and to at least partially close the instep opening 108 of the footwear upper 102). The fastener system 124A/124B may comprise a hook-and-loop fastener or other desired type of fastener (e.g., button(s), snap(s), buckle(s), magnetic fasteners, zippers, laces, etc.). The second side edge 106M of this example further includes a pulling tab 106T or other gripping element to assist the user with grasping and pulling actions to secure the footwear upper 102 to the wearer's foot, ankle, and/or leg. The pulling tab 106T may have other structures from that specifically illustrated to enhance grip and tightening around the wearer's foot, such as one or more of: a loop structure, a through hole structure (e.g., a hole extending from the exterior upper layer 120X through the interior upper layer 1201), a grip element engaged with the footwear upper 102, etc. This example footwear upper 102 additionally includes a bottom flap 126 extending downward and/or outward from the securing flap 122. The bottom flap 126, when present, may cover the forward edge 108F of the instep opening 108, e.g., to help assure the instep opening 108 remains closed. If desired, a hook-and-loop fastener or other type of fastener may releasably hold the bottom flap 126 to the instep region of the exterior upper layer 120X. In this manner, the footwear upper 102 (including the bladder system 600 as will be described in more detail below) will substantially surround and wrap the wearer's ankle, heel, and/or leg regions (and optionally contain and wrap some or all of the Achilles tendon region of a wearer's leg), and the bladder system 600 will be positioned and configured to apply compressive force to the wearer's ankle, heel, and/or leg regions, as will be described in more detail below. In some examples of this technology, the footwear upper 102 (including the bladder system 600 as will be described in more detail below) will completely wrap the wearer's ankle, heel, and/or leg regions (and optionally completely contain and wrap the Achilles tendon region of a wearer's leg).

Now that the basic components and features of article of footwear 100 and the footwear systems have been generally described, additional and more specific features and functions of articles of footwear 100, footwear systems, and/or methods in accordance with examples of this technology will be described in more detail.

Figure 3:
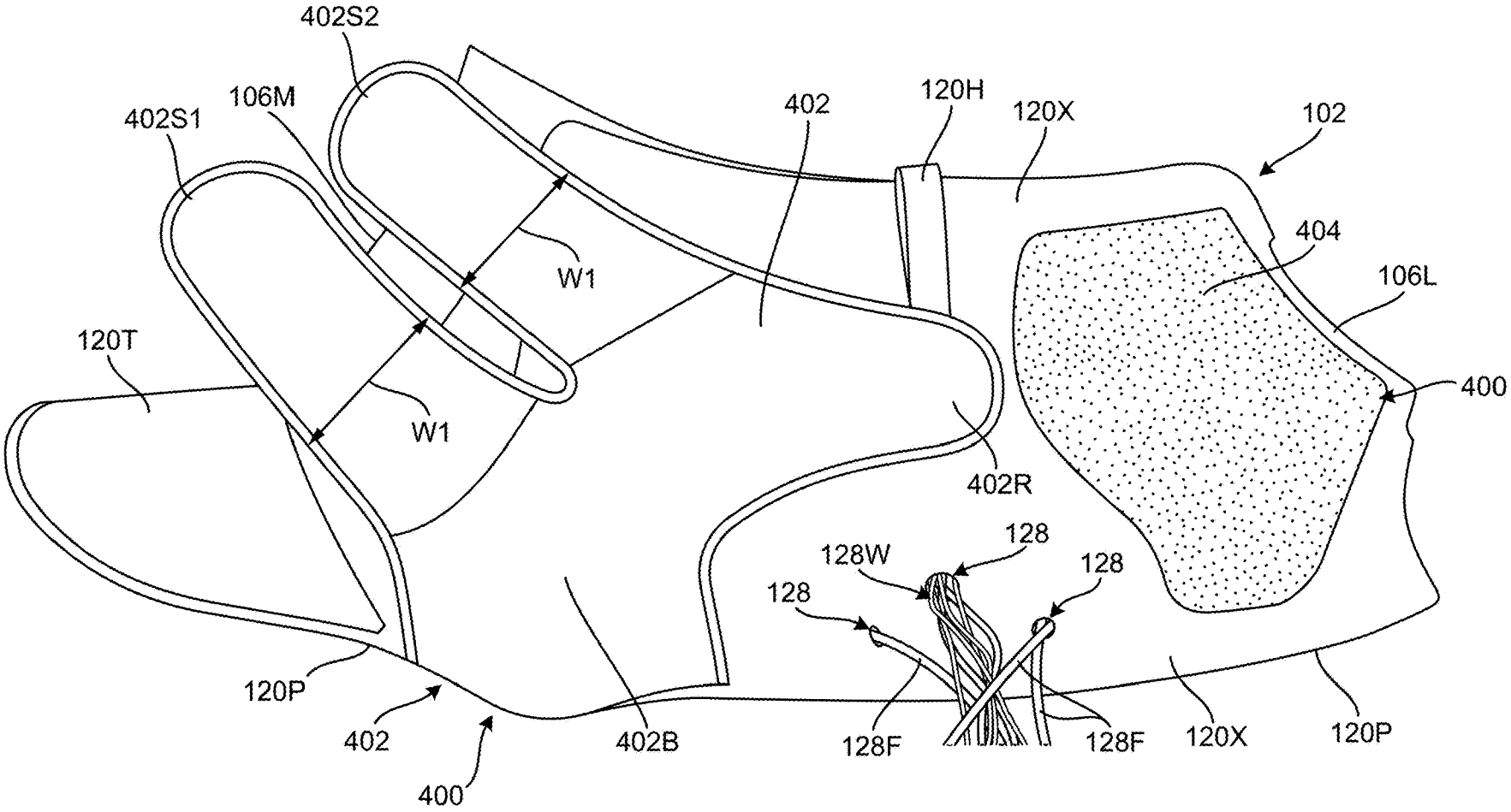
FIG. 3 illustrates an upper blank as a flat component that may be used in footwear uppers, footwear components, articles of footwear, footwear systems, and methods in accordance with some examples of this technology.

FIG. 3 illustrates the footwear upper 102 as an upper blank, e.g., in a flat configuration before it is incorporated into an article of footwear. The footwear upper 102 is made from multiple component parts, including: the exterior upper layer 120X, the interior upper layer 120I (not shown in FIG. 3), a heel pull tab component 120H (e.g., forming a loop), and a forward toc box component 120T. The bottom perimeter edge 120P of the footwear upper 102 may engage a bottom upper component (e.g., a strobel) or a sole member, e.g., to close off the interior chamber of the footwear upper 102 and form the foot-receiving chamber 106.

As further shown in FIG. 3, the lower rear heel area of the exterior upper layer 120X includes one or more openings 128 that lead into the open interior space between the exterior upper layer 120X and the interior upper layer 1201. Three openings 128 are shown in this illustrated example, although more or fewer openings could be provided in other examples of this technology. These openings 128 allow fluid lines 128F and/or wiring 128W (and/or other components) to extend to fluid-filled bladder component parts and/or heating system component parts (and/or other component parts) that are located between the exterior upper layer 120X and the interior upper layer 120I, as will be described in more detail below. These openings 128, the fluid lines 128F, and/or the wiring 128W may be covered by and contained within the housing 300 in the final assembled article of footwear 100, e.g., as shown in FIGS. 2A-2C.

In addition to (or as an alternative to) fastener systems 124A, 124B for releasably engaging the securing flap 122 with the footwear upper 102, this example footwear upper 102 includes a strap system 400. Note FIGS. 2A-2C and 3. This example strap system 400 includes one or more strap members 402 and one or more strap securing members 404. The strap member 402 of this example includes: (i) a side base portion 402B (e.g., located on a medial side of the ankle-containing region of the footwear upper 102); (ii) a rear heel portion 402R extending from the side base portion 402B at least to a rear heel region of the footwear upper 102 (the rear heel portion 402E could extend around the rear heel region to the opposite side of footwear upper 102, if desired), and (iii) a first strap portion 402S1 extending from the first side base portion 402B at least around a forward ankle region of the footwear upper 102. This illustrated example strap member 402 further includes a second strap portion 402S2 extending from the first side base portion 402B and spaced upward on the footwear upper 102 from the first strap portion 402S1. The side base portion 402B, the rear heel portion 402R, and/or the strap securing member(s) 404 may be fixed to another footwear upper 102 component (e.g., to the exterior surface of the exterior upper layer 120X), e.g., by stitching, by adhesives, by fasteners, etc. The first strap portion 402S1 and the second strap portion 402S2 may extend around the forward instep region of the footwear upper 102, optionally over securing flap 122, and releasably engage the strap securing member(s) 404 on the opposite side of the footwear upper 102. While any desired type of releasable connection could be used (e.g., buckles, hooks, snaps, buttons, magnetic fasteners, zippers, laces, etc.), in this illustrated example, the first strap portion 402S1 and the second strap portion 402S2 include portions of a hook-and-loop fastener system that engage complementary portions of the hook-and-loop fastener system provided as strap-securing member 404.

The sizes, shapes, and/or aesthetic appearances of the first strap portion 402S1, the second strap portion 402S2, and the strap-securing member 404 can vary widely from the specific examples shown in these figures. Also, while two strap portions 402S1 and 402S2 are shown in the figures, more or fewer strap portions may be provided to extend across the front and/or instep region of the footwear upper 102 and/or article of footwear 100.

In the illustrated example, each of the first strap portion 402S1 and the second strap portion 402S2 is relatively wide at least at the locations where they cross the instep area and/or the front of the footwear upper 102 and article of footwear 100. In at least some examples of this technology, one or both of the first strap portion 402S1 and/or the second strap portion 402S2 will have a width dimension W1 (see FIG. 3) of at least 35 mm directly across its longitudinal length direction: (i) at locations where the strap portion(s) 402S1 and/or 402S2 cross the first side edge 106L of the footwear upper 102, and/or (ii) at locations where the strap portion(s) 402S1 and/or 402S2 cross the second side edge 106M of the footwear upper 102. Additionally or alternatively, one or both of the first strap portion 402S1 and/or the second strap portion 402S2 may have a width dimension W1 of at least 35 mm directly across its longitudinal length direction at the location where the first strap portion 402S1 and/or the second strap portion 402S2 crosses from a medial side to a lateral side of the footwear upper 102. The width dimension W1 of the first strap portion 402S1 and/or the second strap portion 402S2 may be at least 40 mm, at least 45 mm, at least 50 mm, or even at least 55 mm at any of the locations described above. The two strap portions 402S1 and 402S2 (when two are present) need not have the same width dimensions W1, longitudinal length dimensions, and/or other features. The relatively wide strap portion(s) (e.g., 402S1, 402S2) across the front and/or instep regions of the footwear upper 102 can help keep the underlying components of the footwear upper 102 (e.g., the bladder system 600 and/or the thermal control system) wrapped around the heel, ankle, and/or leg regions of the wearer's body and closely held to the wearer's body.

Figure 4A:
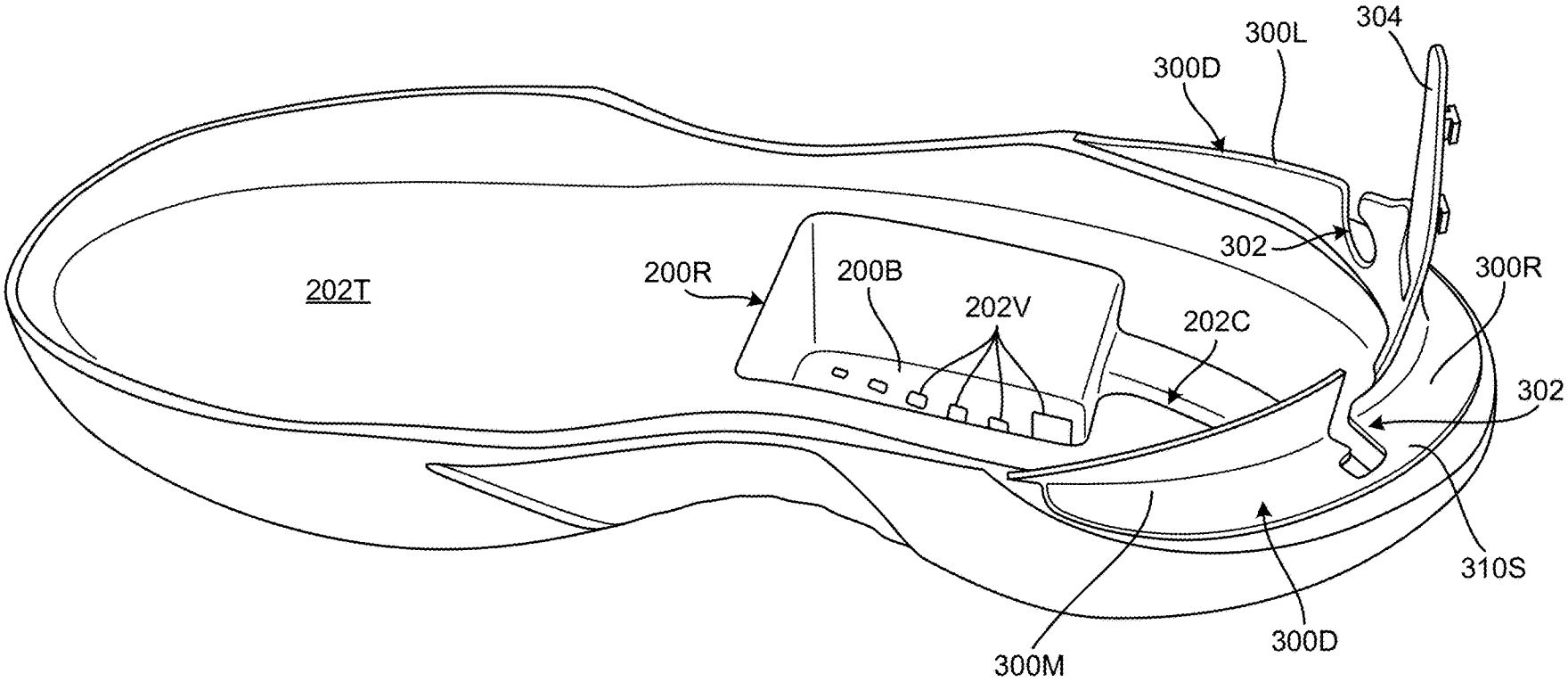
FIGS. 4A and 4B illustrate features of a sole component that may be used in footwear components, articles of footwear, footwear systems, and methods in accordance with some examples of this technology.
Figure 4B:
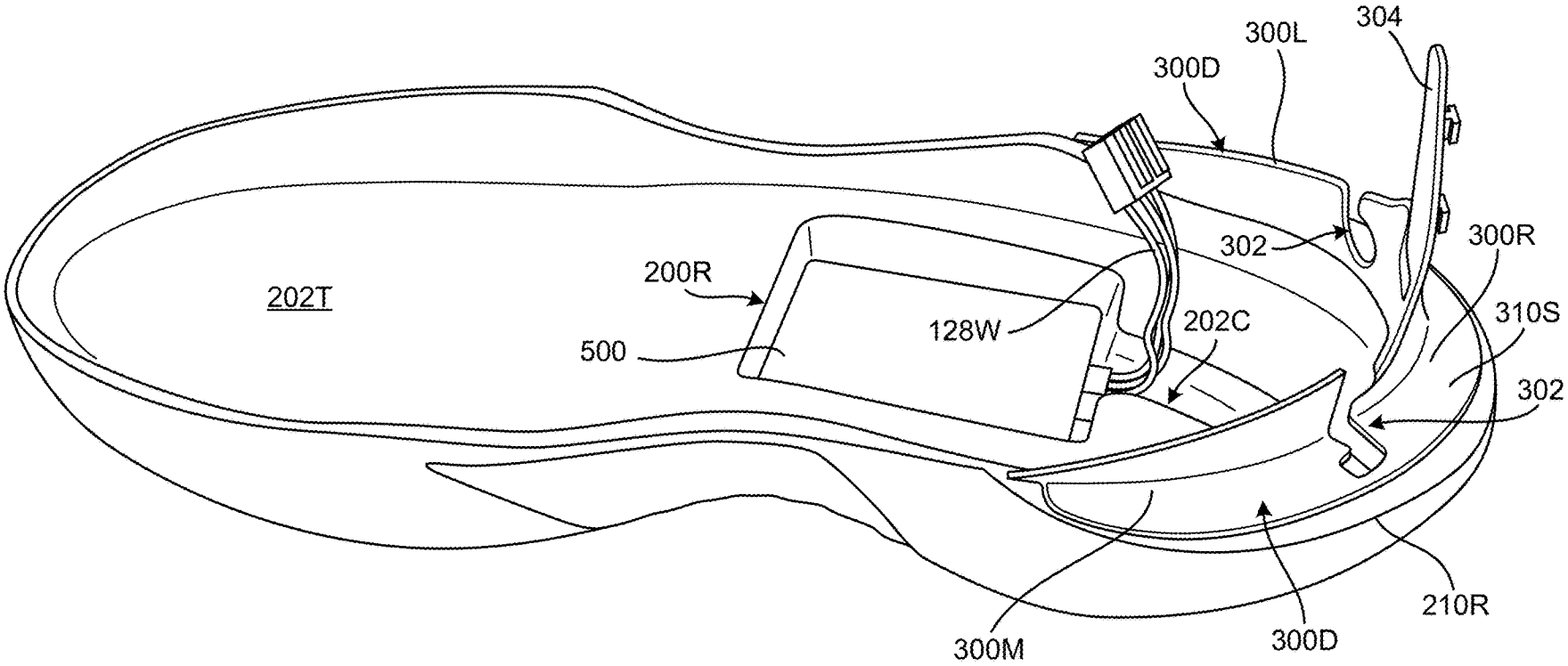

FIGS. 4A and 4B provide top, medial perspective views of an example midsole component 200 before it is attached to a footwear upper 102. The midsole component 200 may be made, at least in part, from a polymeric foam material, including polymeric foam materials as are conventionally known and used in the footwear arts (e.g., polyurethane foams, ethylvinylacetate foams, etc.). The midsole component 200 also may be made from one or more component parts, including: one or more polymeric foam material parts; one or more fluid-filled bladder parts; and/or one or more mechanical shock absorbing parts.

As shown, this example midsole component 200 includes a top surface 202T (located opposite bottom surface 202B discussed above) that has a recess 200R defined in it (e.g., defined in the foam material of the midsole component 200). The recess 200R, as shown in FIG. 4B, may receive at least a portion of a power supply 500 (e.g., a rechargeable battery). The power supply 500 may be used to operate the fluid source component (e.g., pump or compressor), the heating system, the electronic control system, and/or other features of the footwear system, e.g., as will be described in more detail below.

In at least some examples of this technology, the recess 200R (and any power supply 500 included therein) may be accessible, e.g., through an opening in the footwear upper 102 (e.g., an opening defined through the bottom of the footwear upper 102 in the foot-receiving chamber 106, such as an opening through a strobel member provided as a bottom of the footwear upper 102). Additionally or alternatively, in some examples of this technology, the bottom of the footwear upper 102 may include a removable insole component or sockliner that at least partially covers the top surface 202T of the midsole component 200 and/or any strobel member present. As still another additional or alternative option, the bottom surface 202B of the midsole component 200 may include an opening (optionally an opening closed off by a cover member) that allows access to the recess 200R and/or any power supply 500 included therein. Power supply 500 access in such manners may be useful to remove or replace the power supply 500 in at least some examples of this technology.

As illustrated in FIG. 4A, in this illustrated example, the bottom surface 200B of the recess 200R includes one or more vents 202V defined in it (e.g., as through hole openings extending through the midsole component 200 from the bottom surface 200B of the recess 200R to the bottom surface 202B of the midsole component 200. Thus, the vents 202V in this example may open at the bottom exterior surface of the overall sole structure 104 of the article of footwear 100. Note also FIG. 2D. The vents 202V can help dissipate heat generated by the power source 500 during use.

Additionally or alternatively, if desired, one or more elongated channels 202C may be defined in the midsole component 200, e.g., extending from the recess 200R to a rear heel portion of the midsole component 200 and/or to an exterior surface of the midsole component 200. In this example, the elongated channel(s) 202C is (are) formed in the top surface 202T of midsole component 200. The elongated channel(s) 202C may be used as a pathway through which wiring 128W extends between the power source 500 and the interior of the housing 300. See FIG. 4B. Additionally or alternatively, one or more elongated channels 202C of this type may be used as a pathway through which heat may be moved away from the power source 500 (e.g., and to a location outside of the midsole component 200) and/or as a pathway for fluid lines 128F (e.g., to move fluid to and/or between one or more inflatable fluid chambers 602A, 602B of bladder system 600 described in more detail below). One or more elongated channels 202C also may provide a pathway for wiring from port 808 in FIG. 2B to the power source 500 to enable the power source to be recharged (e.g., element 808 in FIG. 2B represents a port for recharging power supply 500, and wiring from this port 808 to the power supply 500 may pass through one or more channels 202C).

FIGS. 4A and 4B further illustrate that this example midsole component 200 includes at least a portion of housing 300 engaged with it. More specifically, FIGS. 4A and 4B illustrate that the rear heel area of midsole component 200 includes a base or "dock" component 300D engaged with it (e.g., by adhesive, by mechanical fasteners, etc.). In this illustrated example, the outer perimeter of the midsole component 200 at the rear heel area of the midsole component 200 includes a lowered rim area 210R, e.g., forming a portion of a top surface of the midsole component 200, and a base surface 310S of the dock component 300D is supported by this rim area 210R on the top surface of the midsole component 200. The rim area 210R and the top outer perimeter of the midsole component 200 extend outward, e.g., beyond the exterior surfaces of the footwear upper 102 at the medial heel side, lateral heel side, and rear heel area of the article of footwear 100. Note also FIGS. 2A-2C. The outwardly extending rim area 210R of this example forms a crescent shaped curved surface that extends around the rear of the midsole component 200 beyond the exterior surface of the footwear upper 102 from the lateral heel region to the medial heel region of the midsole component 200, footwear upper 102, and/or article of footwear 100. Outer perimeter shapes other than crescent shaped also may be provided (e.g., outer perimeter shapes having more angular sides and/or more pronounced corners, etc.). At least some portions of the rim area 210R may extend outward beyond an exterior surface of the footwear upper 102 to provide a base surface to which the dock component 300D may attach that is at least 10 mm wide at some locations, and in some examples, having a widest portion (e.g., at the central, rear heel area) that is at least 12 mm wide, at least 15 mm wide, at least 18 mm wide, or even at least 20 mm wide. This outwardly extending rim area 210R provides a surface onto which the base surface 310S of dock component 300D may be fixed (e.g., by adhesive, by mechanical fasteners, etc.). At locations forward of the dock component 300D, the top outer perimeter edge of the midsole component 200 may substantially correspond to the size and shape of the footwear upper 102 at the junction of the midsole component 200 and the footwear upper 102.

The dock component 300D engages (e.g., snap fits or clips to, engaged by fasteners, etc.) a cover component 300C (e.g., as shown in FIGS. 2A-2C) to form the overall housing 300 and to attach the housing 300 to the midsole component 200. Open space may be defined between the dock component 300D and the cover component 300C (over the base surface 310S of the dock component 300D), and wiring 128W, fluid lines 128F, electronic components, fluid source components 610, and other parts may be included within that open space. As shown in FIGS. 4A and 4B, the dock component 300D may include one or more openings 302 through which some wiring 128W, fluid lines 128F, and/or other components can extend (e.g., the wiring 128W from the power source 500).

Similar to the overall housing 300 described above, in this illustrated example, the dock component 300D includes a lateral arm 300L, a medial arm 300M, and a rear central portion 300R connecting the lateral arm 300L and the medial arm 300M. Additionally, if desired, the rear central portion 300R may include an upwardly extending arm 304. The lateral arm 300L, medial arm 300M, rear central portion 300R, and upwardly extending arm 304 of the dock component 300D may generally complement and match in size and shape to be engaged with corresponding parts of the cover component 300C such that the combined dock component 300D and cover component 300C form the lateral arm 310L, medial arm 310M, rear central portion 310C, and upwardly extending arm 310U of the housing 300. The dock component 300D may be fixed to the footwear upper 102 and/or to the moderator component 312 (when present), in at least some examples of this technology. For example, the interior surfaces of one or more of the lateral arm 300L, the medial arm 300M, the rear central portion 300R, and/or the upwardly extending arm 304 may be attached to the exterior surface of the exterior upper layer 120X and/or to an exterior surface of moderator component 312 (when present), e.g., by an adhesive, by one or more fasteners, etc., e.g., as shown in FIGS. 2A-2C.

FIGS. 2A-2C, 4A, and 4B show the housing 300, including its dock component 300D and cover component 300C having various specific shapes (with a lateral arm 300L, medial arm 300M, rear central portion 300R, and upwardly extending arm 304) and at a specific location on the article of footwear 100 (centered around the rear heel area). Other housing shapes and/or locations are possible in other specific examples of this technology. For example, the housing 300 (e.g., including a dock component 300D and cover component 300C or other housing structure) may be more cubic shaped, rounded shaped, cylindrical shaped, arch shaped, crescent shaped, without an upwardly extending arm, etc., in other specific examples of this technology. Additionally or alternatively, the housing 300 (e.g., including a dock component 300D and cover component 300C or other housing structure of any desired shape) may be mounted to the footwear sole structure 104 (e.g., midsole component 200) and/or footwear upper 102 at a lateral heel area, a medial heel area, a lateral midfoot area, a medial midfoot area, a lateral forefoot area, a medial forefoot area, and/or an instep area. Additionally or alternatively, two or more housings 300 may be provided at any of the locations described above.

In at least some examples of this technology, the cover component 300C may be removably attached to the dock component 300D. Additionally or alternatively, in some examples, one or more screws and/or other fasteners may be provided to releasably secure the cover component 300C to the dock component 300D. As a more specific example, at least one screw or bolt may be provided to extend downward through the top of the rear central portion 310C of the cover component 300C (e.g., at location 314 shown in FIG. 2C), and this screw or bolt may releasably secure to a threaded receptacle provided on the dock component 300D. A top, central fastener component at such a location may help prevent the housing 300 from pulling away from the footwear upper 102.

Figure 5:
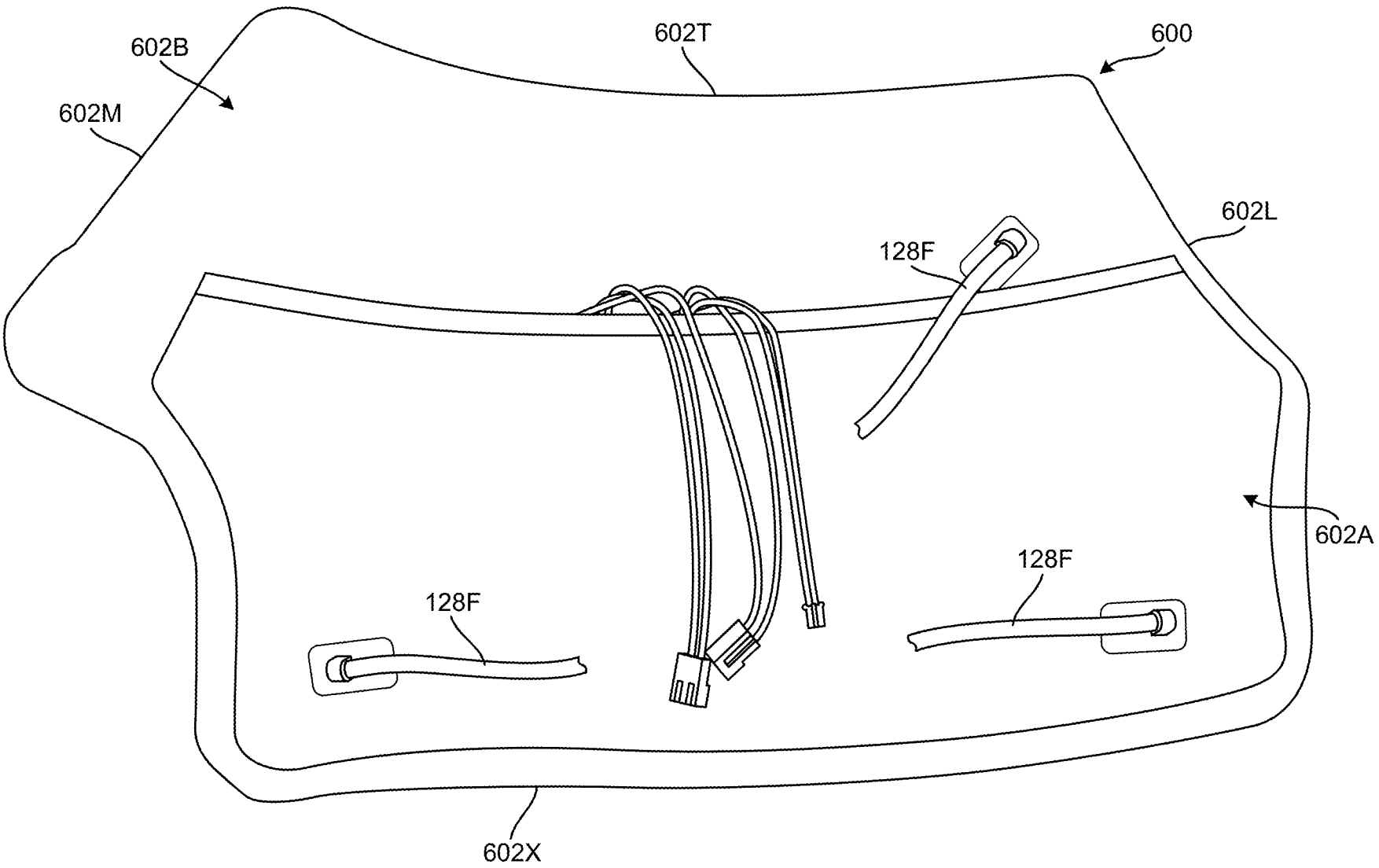
FIG. 5 illustrates a bladder component that may be used in footwear uppers, footwear components, articles of footwear, footwear systems, and methods in accordance with some examples of this technology.

As described above, at least some aspects of this technology relate to features of applying compressive force to a wearer's foot, ankle, and/or leg. This is accomplished, in accordance with aspects of this technology, by inflating a fluid-filled bladder system 600 (including at least one inflatable fluid chamber) located between the interior upper layer 1201 and the exterior upper layer 120X. FIG. 5 illustrates an example of such a fluid-filled bladder system 600. Fluid-filled bladder systems 600 for use with this technology may be made from materials and using techniques as used in the footwear arts for forming fluid-filled bladders used for footwear midsoles (e.g., from thermoplastic elastomeric sheets that are joined together by one or more seams (e.g., using heat and pressure, using welding techniques, etc.) to define the inflatable chambers). As shown in FIG. 5, this example fluid-filled bladder system 600 includes two inflatable fluid chambers 602A (the lower chamber) and 602B (the upper chamber). The fluid chambers 602A, 602B extend from a medial side edge 602M to a lateral side edge 602L and from a top edge 602T to a bottom edge 602X. In this illustrated example, the two inflatable fluid chambers 602A, 602B will be located between the interior upper layer 1201 and the exterior upper layer 120X and extend: (a) from a location proximate to first side edge 106L of the footwear upper 102 to a location proximate to the second side edge 106M of the footwear upper 102, and/or (b) from a location proximate to the top edge 106E of the footwear upper 102 to a location proximate to the bottom perimeter edge 120P of the footwear upper 102. Thus, in this manner, the two inflatable fluid chambers 602A, 602B are configured to completely wrap around a wearer's lower leg and/or ankle region (or at least wrap around the lateral, rear, and medial ankle-containing region of the footwear upper 102). In addition or as an alternative to providing compressive forces, the fluid-filled bladder system 600 may provide an improved and conforming fit of the article of footwear 100 to a wearer's foot, ankle, and/or leg (e.g., eliminating or reducing space between the footwear upper 102 and the wearer's foot, ankle, and/or leg when the footwear is donned).

In at least some examples of this technology, the two inflatable fluid chambers 602A and 602B may be isolated from one another, e.g., not in fluid communication, so that different pressures can be set, controlled, and maintained in the two fluid chambers 602A, 602B. As shown in FIG. 5, in this illustrated example, separate fluid lines 128F may be provided for each fluid chamber 602A, 602B, and an additional fluid line 128F may be provided as a pressure sensor tube. Alternatively, if desired, the two fluid chambers 602A, 602B may be in fluid communication with one another, so that at least some fluid can move in either or both directions between fluid chamber 602A and fluid chamber 602B. The fluid-filled bladder system 600 may be secured with the footwear upper 102 (e.g., with one or both of the exterior upper layer 120X and/or the interior upper layer 1201), e.g., by adhesives, by sewn seams, by mechanical fasteners. Alternatively, if desired, the fluid-filled bladder system 600 may be loose between the exterior upper layer 120X and/or the interior upper layer 1201 (e.g., and held therein due to the seam(s) or other structure holding exterior upper layer 120X with the interior upper layer 1201). In some examples of this technology, fluid pressure in either or both fluid chamber 602A and/or 602B may be cycled between a relatively high pressure condition and a relatively low pressure condition (e.g., to apply a pulsating compression force against the wearer's foot, leg, and/or ankle).

While FIG. 5 illustrates a fluid-filled bladder system 600 that includes two fluid chambers 602A, 602B, other structures are possible. For example, a single fluid chamber may be provided, or more than two fluid chambers may be provided (having any desired combination of fluid chambers isolated from one another and/or fluid chambers in fluid communication with one another). As another option, when two (or more) fluid chambers are in fluid communication with one another, they may be in fluid communication in a manner that enables control of the pressure between the fluid chambers, e.g., using a controllable valve. As yet another option, when two (or more) fluid chambers are in fluid communication with one another, they may be in fluid communication in a manner such that a pressure differential between the two fluid chambers will equalize at a controlled and/or predictable rate (e.g., by providing one or more narrow fluid passageways between the two fluid chambers so that fluid transfers slowly but predictably between the chambers until the chamber pressures equalize).

Figure 6:
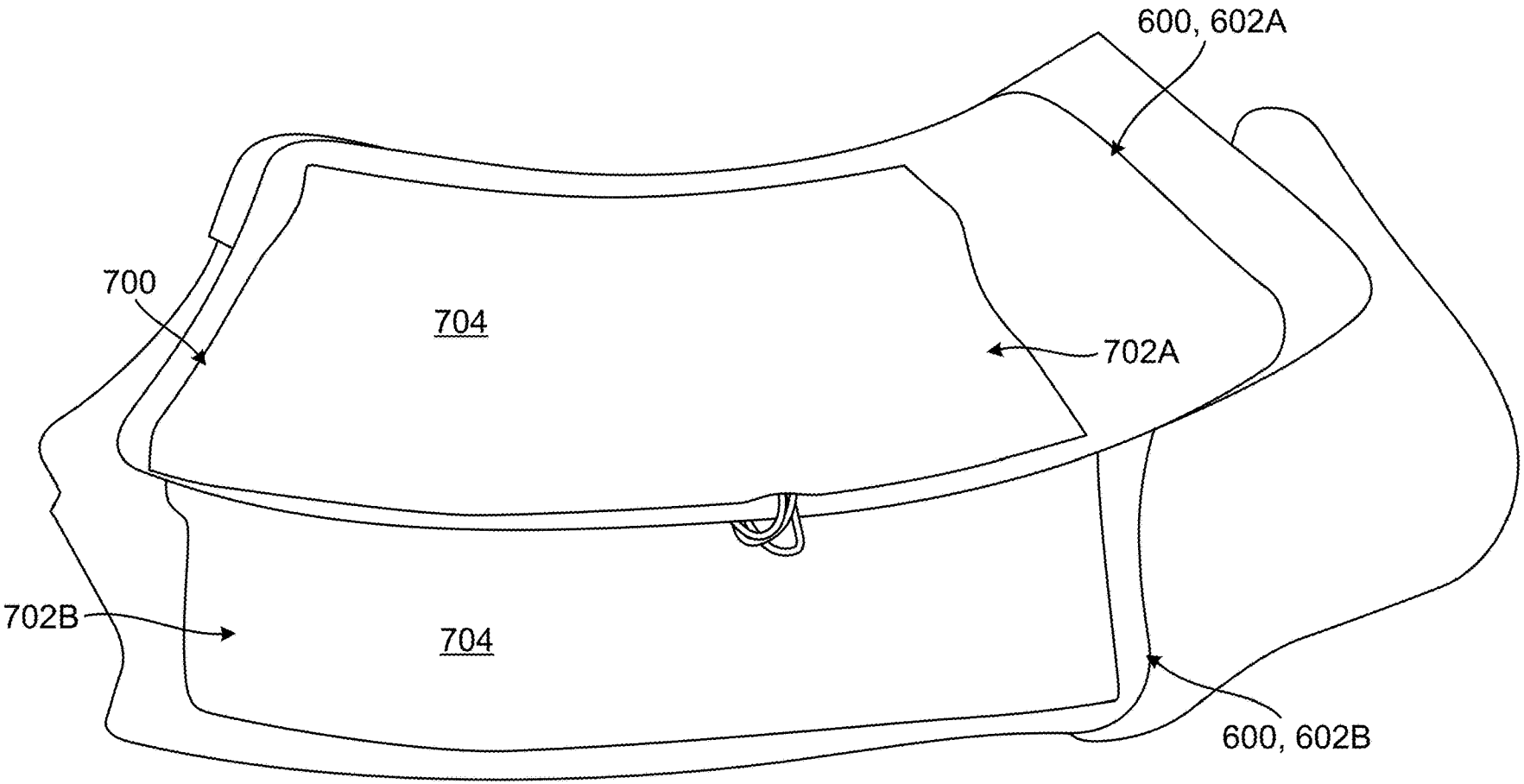
FIG. 6 illustrates a heating system engaged with a bladder component that may be used in footwear uppers, footwear components, articles of footwear, footwear systems, and methods in accordance with some examples of this technology.

As also described above, at least some aspects of this technology relate to features of applying heat to a wearer's foot, ankle, and/or leg. This is accomplished, in accordance with aspects of this technology, by heating system 700 (including at least one heating region or zone) located between the interior upper layer 1201 and the exterior upper layer 120X. FIG. 6 illustrates an example of such a heating system 700 (attached to a surface of fluid-filled bladder system 600). Any desired type of heating systems 700 may be used with this technology. As some more specific examples, the heating system 700 may include a resistor pattern applied to a base member, e.g., of the types provided in commercial products available from Hyperice, Inc. As shown in FIG. 6, this example heating system 700 includes two heating zones 702A (the lower zone) and 702B (the upper zone). The lower zone 702A is joined with the lower fluid chamber 602A of the fluid-filled bladder system 600 (e.g., by an adhesive, etc.) and the upper zone 702B is joined with the upper fluid chamber 602B of the fluid-filled bladder system 600 (e.g., by an adhesive, etc.) in this example. The two heating zones 702A, 702B are located between the interior upper layer 1201 and the exterior upper layer 120X. In this manner, the two heating zones 702A, 702B are configured to apply heat to a wearer's foot, lower leg, and/or ankle region.

In at least some examples of this technology, the two heating zones 702A and 702B may be isolated from one another, e.g., so that different temperatures can be set, controlled, and maintained in the two heating zones 702A, 702B. Separate temperature controls may be provided for each zone 702A, 702B. The heating system 700 may be secured with the footwear upper 102 along with the fluid-filled bladder system 600 (e.g., with one or both of the exterior upper layer 120X and/or the interior upper layer 1201). In some examples, the heating system 700 will be fixed to an interior surface of bladder system 600, and the bladder system 600 may be fixed to one or more of the footwear upper 102 components. In at least some examples of this technology, an additional layer of fabric or other material 704 may be provided over the layer of the heating system 700 including the heating element (e.g., the heat generating resistors). This additional layer of fabric or other material 704 may be placed between the wearer's foot, leg, and/or ankle and the heating elements to spread out and/or moderate the feel of the heating elements on the wearer's foot, leg, and/or ankle. The additional layer of fabric or other material 704 (if present) and the interior upper layer 1201 may be made sufficiently thin and/or heat conductive, e.g., so as not to significantly impede the thermal transfer (e.g., the transfer of heat from the heating system 700) to the wearer's foot, ankle, and/or leg.

While FIG. 6 illustrates a heating system 700 that includes two heating zones 702A, 702B, other structures are possible. For example, a single heating zone may be provided, or more than two heating zones may be provided. As another option, when two (or more) heating zones are present, they may be separately controlled so that different temperatures can be set, controlled, and maintained in each zone.

Figure 7A:
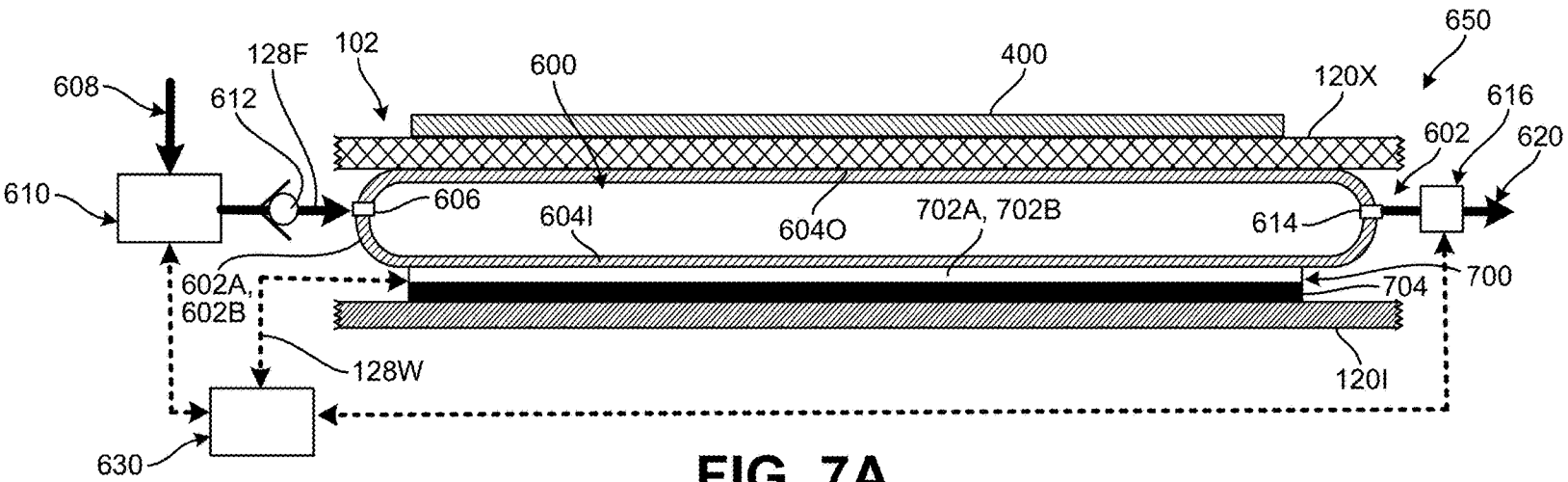
FIGS. 7A and 7B schematically illustrate features of footwear systems in accordance with some examples of this technology.

FIG. 7A schematically shows a sectional view through one side of the footwear upper 102 along with other components making up a footwear system 650 in accordance with at least some examples of this technology. As shown in FIG. 7A, this example footwear system 650 includes an interior space 602 defined between the exterior upper layer 120X and interior upper layer 1201. The combined fluid-filled bladder system 600 and heating system 700 are included within that interior space 602. In this illustrated example, the heating system 700 (including heating element zones 702A, 702B and material 704) is located on (e.g., optionally engaged with) an inside surface 6041 of the fluid-filled bladder system 600 and adjacent the interior upper layer 120I (so as to efficiently transfer heat to the wearer's leg, foot, and/or ankle region). The heating system 700 may be fixedly secured to the interior upper layer 1201, or it may be unfixed. The outer surface 6040 of the fluid-filled bladder system 600 is positioned adjacent the exterior upper layer 120X, and this outer surface 6040 may be fixedly secured to the exterior upper layer 120X, or it may be unfixed. FIG. 7A further shows a portion of the strap system 400 engaged with the exposed exterior surface of the exterior upper layer 120X.

The example footwear system 650 of FIG. 7A further includes a fluid source component 610 (e.g., a pump, a compressor, etc.) in fluid communication with the fluid-filled bladder system 600 (e.g., with one or more of the fluid chambers 602A, 602B). The fluid source component 610 may be located in the housing 300, e.g., shown in FIGS. 2A-2C. The fluid source component 610 may receive incoming fluid (e.g., air from the exterior environment) or other fluid via fluid inlet port 608 and supply this fluid to a fluid chamber 602A or 602B via fluid line 128F and bladder inlet 606. A check valve 612 (e.g., in fluid line 128F or in bladder inlet 606) can be provided to prevent fluid from backflowing out of the fluid chamber 602A/602B via fluid line 128F.

The fluid chamber(s) 602A and/or 602B of this illustrated example further includes a bladder outlet 614 that may be controlled by a valve 616 (e.g., an electronically controlled valve). When the valve 616 is open, fluid can be discharged from the fluid chamber(s) 602A and/or 602B via bladder outlet 614, e.g., to the external environment or to an internal reservoir included with the footwear system 650. Note fluid outlet port 620. Valve 616 may be provided within the housing 300. Additionally or alternatively, if desired, fluid inlet port 608 and/or fluid outlet port 620 may be defined through a wall of housing 300 (see FIG. 2C) and/or may be provided on another component of the overall article of footwear 100. When multiple fluid chambers 602A, 602B are present, each chamber may have its own connection to the fluid source component 610, its own bladder inlet 606, its own bladder outlet 614, its own valve 616, and/or its own outlet port 620. Alternatively, if desired, the multiple fluid chambers 602A, 602B may share at least some of these components (e.g., the same inlet port 608, the same valve 616, and/or the same outlet port 620). Fluid inlet port 608 and fluid outlet port 620 may constitute a single common port through the housing 300 cover. Additionally or alternatively, if desired, fluid inlet port 608 and/or fluid outlet port 620 may constitute a vent for venting any excess heat accumulated in the housing 300.

An electronic controller 630 may control operation of the fluid source component 610 and the valve 616 to control fluid pressure within the fluid chamber(s) 602A and/or 602B. Such electronic controllers 630 may include one or more of: (a) input devices (e.g., input ports, or an antenna for receiving user input, program instructions, program code, etc.); (b) one or more microprocessors (e.g., for performing operations on the data and/or performing other functions); and (c) one or more output devices (e.g., output ports or connections providing electronic signals for operating one or more of the fluid source component 610, the valve 616, and/or (as described below), the heating system 700. Programmable electronic controller hardware components of this type are known and commercially available. By selectively controlling operation of the fluid source component 610 and the valve 616, fluid pressure in the fluid chamber(s) 602A and/or 602B can be changed and controlled. In this manner, compressive force applied to a wearer's foot, leg, and/or ankle also can be changed and controlled. Power source 500 (e.g., a battery, see FIG. 4B) provides power to operate one or more of the fluid source component 610, the valve 616, and/or the controller 630 (e.g., to independently operate or control fluid pressures in the fluid chambers 602A, 602B).

FIG. 7A further illustrates that controller 630 may control the heating system 700, e.g., supplying electronic signals indicating when one or more of the heating zones 702A and/or 702B should be activated. By selectively controlling operation of the heating system 700, the heat applied to a wearer's foot, leg, and/or ankle also can be controlled. Power source 500 (e.g., a battery, see FIG. 4B) also provides power to operate the heating system 700 (e.g., to independently operate or control the heating zones 702A, 702B). Electronic controllers for controlling heating systems 700 are known and are commercially available.

The bladder system 600 example of FIG. 7A described above includes a fluid source 610, such as a pump or compressor, that intakes air (e.g., from the external environment) via fluid inlet port 608 and discharges air via fluid outlet port 620. If necessary or desired, the footwear system 650 of FIG. 7A may include features to reduce or eliminate the introduction of water/moisture and/or debris into the footwear system 650 through the ports 608/620 and/or entrained with the incoming air. For example, the fluid inlet port 608 and/or the fluid outlet port 620 may include a filter or air permeable membrane that allows air to pass but stops moisture and/or solid materials from passing (e.g., a waterproof, breathable fabric membrane).

Additionally or alternatively, the interior of the fluid chamber(s) 602A and/or 602B may include one or more of a desiccant material, a mold growth inhibitor, and/or a mildew inhibitor (e.g., as a coating, as an insert, etc.), e.g., to prevent collection of water, formation of mold and/or mildew, etc. within the bladder system 600. Other ways of controlling undesired introduction, collection, and/or formation of water, moisture, mold, mildew, and/or debris also may be used in other specific examples of this technology.

Figure 7B:
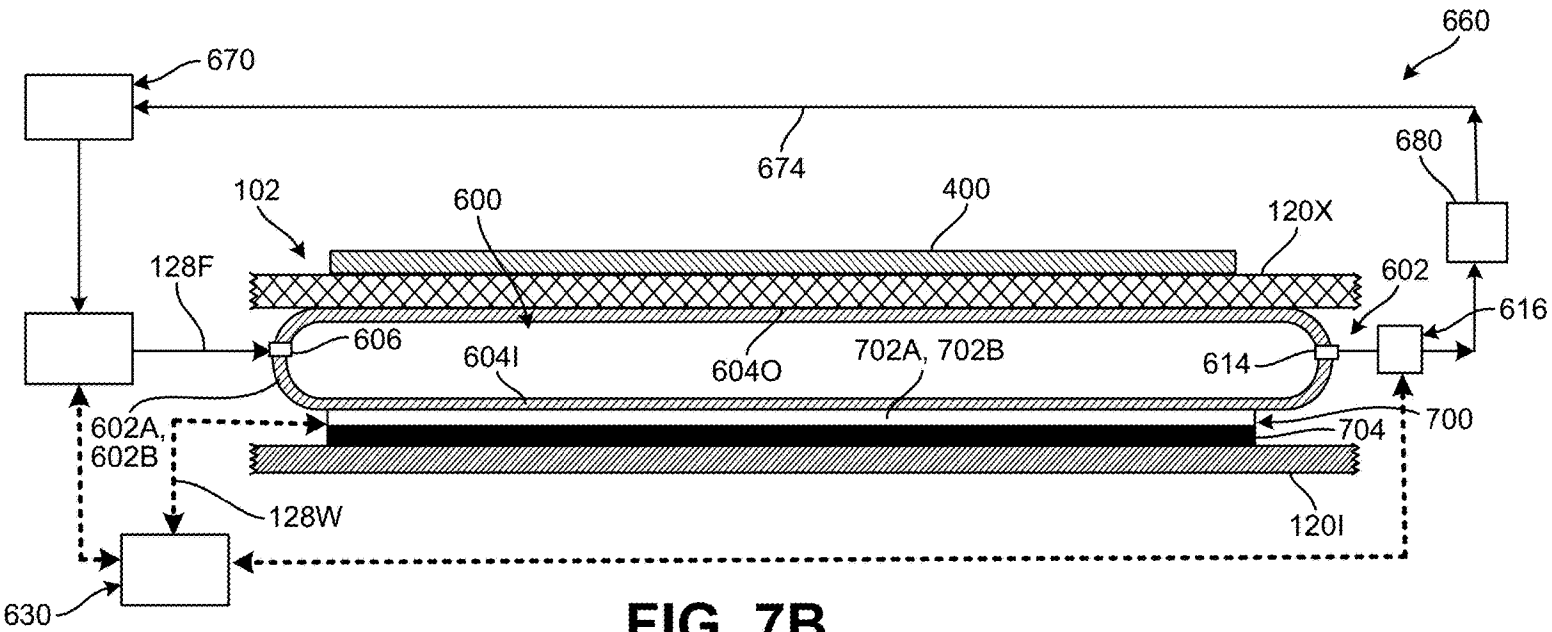

As another example, the fluid source may be formed as part of a "closed system," e.g., including a reservoir chamber. FIG. 7B schematically shows an example of such a closed system 660. Where the same reference numbers are used in FIG. 7B as used in FIG. 7A and the other figures contained herein, the same or similar parts are being referenced, and much of the overlapping and/or repetitive description may be omitted. As shown in FIG. 7B, such a closed system 660 may include: (i) a compressive force applying bladder chamber (e.g., provided in the footwear upper 102, such as one or more of fluid chamber(s) 602A and 602B described above) in fluid communication with (ii) a reservoir chamber 670 (e.g., a bladder or other reservoir provided at another location within the article of footwear 100, such as within the midsole component 200, engaged with the footwear upper 102, etc.). When compressive force is to be applied to the wearer's foot, ankle, and/or leg, fluid is moved from the reservoir chamber 670 to the fluid chamber 602A/602B, e.g., via fluid line 672, valve 676 (or switch), fluid line 128F, and bladder inlet 606. When increased compressive force is to be applied to the wearer's foot, ankle, and/or leg, additional fluid is moved from the reservoir chamber 670 to the fluid chamber 602A/602B, e.g., via fluid line 672, valve 676 (or switch), fluid line 128F, and bladder inlet 606. When decreased compressive force is to be applied to the wearer's foot, ankle, and/or leg, fluid is moved from the fluid chamber 602A/602B to the reservoir chamber 670 (e.g., via bladder outlet 614, valve 616, pump 680, and fluid line 674). In such closed systems 660, the fluid remains within the article of footwear 100 and just moves between different chambers (the bladder chamber 602A/602B and reservoir 670), depending on the compressive force to be applied. In closed systems, a single reservoir 670 may be in fluid communication with more than one bladder chamber (e.g., 602A, 602B) or zone or each bladder chamber (e.g., 602A, 602B) may connect with a separate reservoir 670. Closed systems 660 of these types may have a reduced likelihood of collecting water and/or debris and/or developing mold and/or mildew, etc. within the bladder system 600.

In such closed systems 660, if the fluid pressure is maintained higher in the reservoir chamber 670 than in the bladder fluid chamber 602A/602B, then: (a) valve 676 (or switch) may be selectively opened to transfer fluid into the fluid chamber 602A/602B (and thereby increase fluid pressure in the fluid chamber 602A/602B) and (b) pump 680 may be selectively activated to move fluid from the fluid chamber 602A/602B to the reservoir chamber 670 (and thereby decrease fluid pressure in the fluid chamber 602A/602B). But if the fluid pressure is maintained higher in the bladder fluid chamber 602A/602B than in the reservoir chamber 670, then a pump (e.g. akin to pump 610 in FIG. 7A) may be provided and selectively activated to transfer fluid from the reservoir chamber 670 into the fluid chamber 602A/602B (and thereby increase fluid pressure in the fluid chamber 602A/602B) and (b) a valve or switch may be provided and selectively activated to move fluid from the fluid chamber 602A/602B to the reservoir chamber 670 (and thereby decrease fluid pressure in the fluid chamber 602A/602B). In other words, if the fluid pressure is maintained higher in the bladder fluid chamber 602A/602B than in the reservoir chamber 670, the valve 676 (or switch) and pump 680 will switch positions in the example schematic diagram of FIG. 7B.

Closed fluid systems that include fluid bladders, fluid reservoirs, bladder/reservoir interconnections, bladder and/or reservoir engagements with footwear components, and/or movement of fluid between a bladder and a reservoir are described in U.S. Pat. No. 11,206,896 B2, U.S. Pat. No. 11,234,485 B2, and U.S. Patent Appln. Publn. No. 2024/0215683 A1, each of which is entirely incorporated herein by reference. These patent documents illustrate examples of closed system components, their mounting in footwear, and interconnection features that may be used in examples of the present technology, e.g., as shown in FIG. 7B.

Figure 8A:
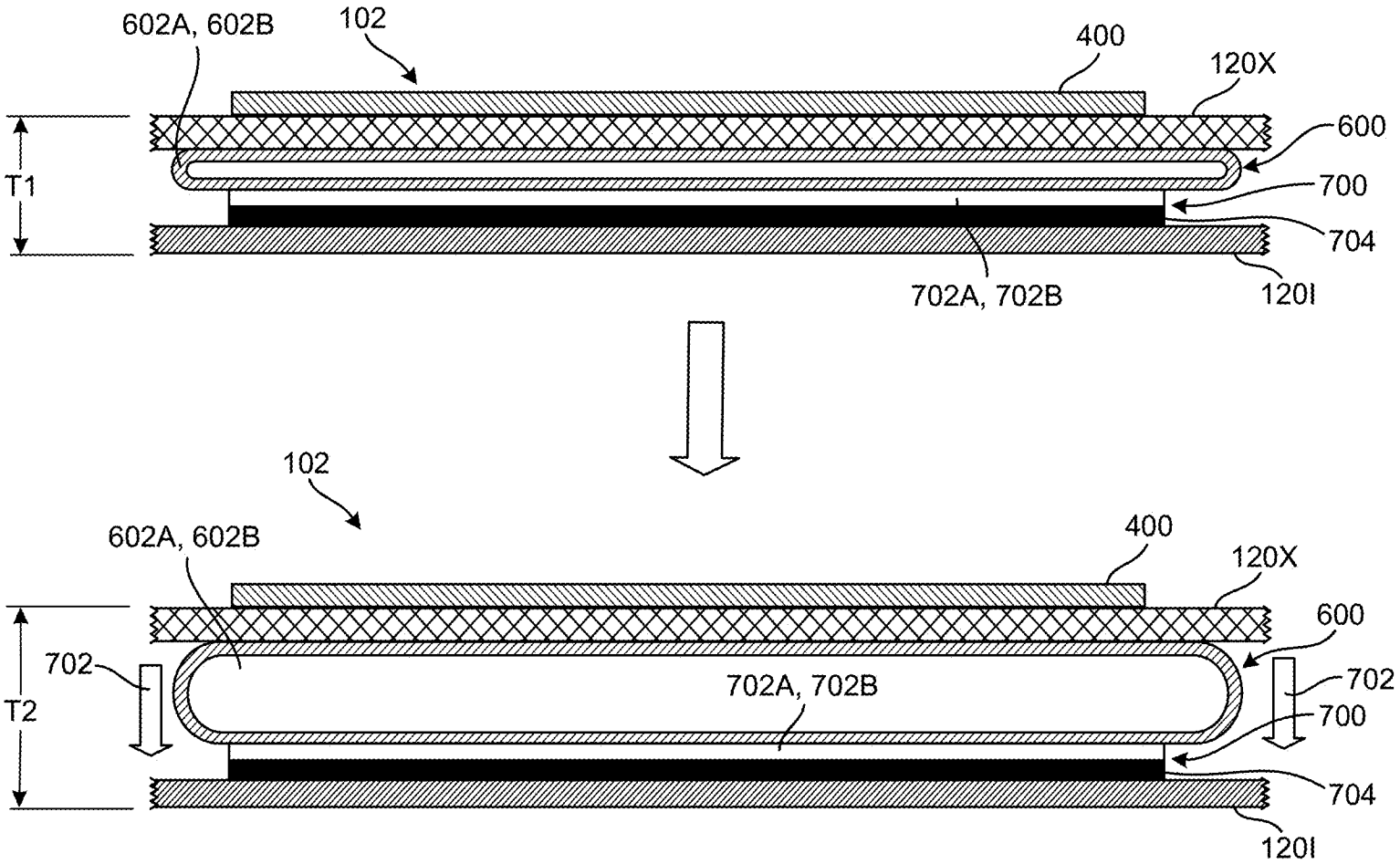
FIGS. 8A and 8B illustrate features of upper displacement and application of compression in footwear uppers, footwear components, articles of footwear, footwear systems, and methods in accordance with some examples of this technology.
Figure 8B:
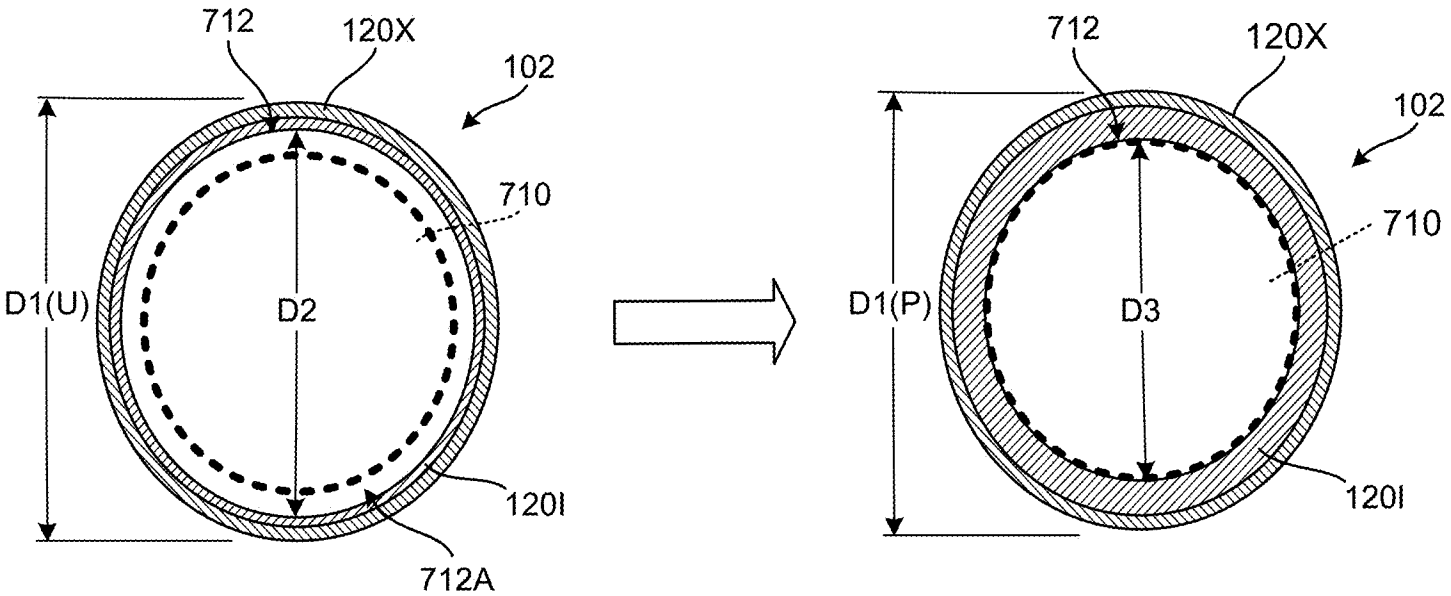

FIGS. 8A and 8B further illustrate operation of footwear systems 650, 660 of the types described above. FIG. 8A includes a view of a footwear upper 102 similar to the view of FIG. 7A in an unpressurized configuration (the top of FIG. 8A) and in a pressurized configuration (the bottom of FIG. 8A). FIG. 8B schematically illustrates a view of an ankle-containing region of the footwear upper 102 in the unpressurized configuration (the left side of FIG. 8B) and in the pressurized configuration (the right side of FIG. 8B). These figures help illustrate potential displacement of portions of the footwear upper 102 during use of the footwear systems 650, 660 in some examples of this technology. When the fluid-filled bladder system 600 is in the unpressurized configuration, the fluid chamber(s) 602A and/or 602B may be collapsed (or collapsible), thereby giving the footwear upper 102 a first thickness dimension T1 (e.g., measured from the exterior surface of exterior upper layer 120X to the interior surface of interior upper layer 1201, as shown in FIG. 8A). Pressurization of the fluid-filled bladder system 600 using fluid source component 610 (e.g., with valve 616 closed) causes one or both of fluid chambers 602A and/or 602B to inflate. Such inflation in this structure causes displacement of the interior upper layer 1201 with respect to the exterior upper layer 120X, as shown by arrows 702, thereby increasing the thickness to a second thickness dimension T2.

Thus, in the example above, the second thickness dimension T2 (in the inflated or pressurized configuration) will be greater than the first thickness dimension T1 (in the uninflated or unpressurized configuration). In at least some examples of this technology, T2 may be at least 1.1×T1, at least 1.25×T1, at least 1.4×T1, at least 1.5×T1, at least 1.75×T1, or even at least 2×T1.

FIG. 8B illustrates the effect of pressurization of the fluid-filled bladder system 600 at the ankle-containing region 712 of a footwear upper 102 in accordance with at least some examples of this technology. FIG. 8B schematically illustrates a wearer's foot, ankle, or leg 710 included within the ankle-containing region 712 of footwear upper 102. In this example structure, each of the interior upper layer 1201, the fluid chamber(s) (602A, 602B), and the exterior upper layer 120X extend to form at least a lateral ankle-containing region, a rear ankle-containing region, and a medial ankle-containing region of the footwear upper 102 (with the fluid chamber(s) 602A, 602B being located within a space between the interior upper layer 1201 and the exterior upper layer 120X in the view of FIG. 8B). In at least some examples of this technology, each of the interior upper layer 1201, the fluid chamber(s) (602A, 602B), and the exterior upper layer 120X extend to close the ankle-containing region 712 when the securing system (e.g., fastener system 124A, 124B, strap system 400, etc.) places the footwear upper 102 in a closed configuration.

In the unpressurized configuration (the left side of FIG. 8B), a space 712A may exist between the interior upper layer 1201 and the surface of the wearer's foot, ankle, and/or leg 710 around at least some portion of the perimeter of the wearer's foot, ankle, and/or leg 710. Once sufficiently pressurized, the interior upper layer 1201 of the footwear upper 102 may displace with respect to the exterior upper layer 120X as discussed above in conjunction with FIG. 8A. This displacement may eliminate space 712A and cause the interior surface of the interior upper layer 1201 to move into contact with the wearer's foot, ankle, and/or leg 710, e.g., around the complete perimeter of the wearer's foot, ankle, and/or leg 710, as shown on the right side of FIG. 8B. This action improves the fit of the article of footwear 100 to the wearer's foot, ankle, and/or leg 710 and applies a compressive force to the wearer's foot, ankle, and/or leg 710. The fastener system 124A/124B and/or the strap system 400 may be tightened around the wearer's foot, ankle, and/or leg 710 before pressurization of the bladder system 600, e.g., to make the space 712A as small as possible and/or to maximize the compressive force application capabilities of the footwear system.

As further shown in FIG. 8B, displacement of the interior upper layer 1201 of the footwear upper 102 with respect to the exterior upper layer 120X causes an internal transverse dimension of the ankle-containing region 712 to change from D2 (unpressurized) to D3 (pressurized). In at least some examples of this technology, the change from the unpressurized configuration to the pressurized configuration may be capable of changing an internal transverse dimension of the ankle-containing region 712 within the following ranges: D2 may be at least 1.05×D3, at least 1.1×D3, at least 1.15×D3, at least 1.2×D3, at least 1.25×D3, or even at least 1.4×D3.

In order for a compressive force to be applied to a wearer's foot, leg, and/or ankle when the fluid-filled bladder system 600 changes between an unpressurized configuration or condition and a pressurized configuration or condition, the footwear upper 102 of this example is configured so that the interior upper layer 1201 displaces inwardly toward a center of the ankle-containing region 712. If the exterior upper layer 120X displaces outward too much upon bladder system 600 pressurization, then insufficient compressive force or no compressive force may be applied to the wearer's foot, leg, and/or ankle 710. Thus, in at least some examples of this technology, a transverse dimension of the footwear upper 102 at the ankle-containing region 712 (from the exterior surface of the exterior upper layer 120X to the exterior surface of the exterior upper layer 120X at an opposite side of the ankle-containing region 712) in the unpressurized configuration (D1(U)) will be substantially equal to the transverse dimension of the footwear upper 102 at the ankle-containing region 712 in the pressurized configuration (D1 (P)). In at least some examples of this technology, the term "substantially equal" as used herein in this context will mean that D1 (P)=D1 (U)±10%. In some additional examples of this technology, D1(P)=D1(U)±7.5% or even D1(P)=D1(U)±5%.

To help assure that displacement takes place in the desired direction (inwardly) in at least some examples of this technology, the interior upper layer 1201 may be made to have a first stretchability and the exterior upper layer 120X may be made to have a second stretchability, wherein the first stretchability is greater than the second stretchability. In other words, in at least some examples of this technology, the interior upper layer 1201 may be made more "stretchable" than the exterior upper layer 120X. In this manner, force applied to the footwear upper 102 by inflation and displacement of the bladder system 600 will tend to predominantly stretch the interior upper layer 1201 (because it is easier to do so), thereby causing the interior upper layer 1201 to stretch and displace inwardly.

Additionally or alternatively, in at least some examples of this technology, the interior upper layer 1201 may be made to have a first stiffness and the exterior upper layer 120X may be made to have a second stiffness, wherein the second stiffness is greater than the first stiffness. In other words, in at least some examples of this technology, the exterior upper layer 120X may be made from "stiffer" material(s) than the interior upper layer 1201. In this manner, force applied to the footwear upper 102 by inflation and displacement of the bladder system 600 will tend to predominantly displace the less stiff interior upper layer 1201 (because it is easier to do so), thereby causing the interior upper layer 1201 to displace inwardly.

Still additionally or alternatively, other features of the footwear upper 102 can help assure that that displacement of the footwear upper 102 takes place inwardly in a direction to apply compressive force to a wearer's leg, foot, and/or ankle in the ankle-containing region 712. For example, as shown in FIGS. 2B and 3, the side base portion 402B and/or the rear heel portion 402R of the strap system 400 is applied to an exterior surface of the exterior upper layer 120X at least at one side (e.g., the medial side in this illustrated example) of the footwear upper 102. These portions of the strap system 400 may be formed from a relatively unstretchable and/or stiff material, e.g., to prevent or to help prevent stretch and/or to increase stiffness of the underlying exterior upper layer 120X. Additionally or alternatively, as shown in FIGS. 2A and 3, the strap securing member(s) 404 of the strap system 400 is applied to an exterior surface of the exterior upper layer 120X at least at one side (e.g., the lateral side in this illustrated example) of the footwear upper 102. These strap securing member(s) 404 may be formed from a relatively unstretchable and/or stiff material, e.g., to prevent or to help prevent stretch and/or to increase stiffness of the underlying exterior upper layer 120X. Other upper components and/or structural features could be used to help bias footwear upper 102 displacement in the desired direction(s).

Figure 9A:
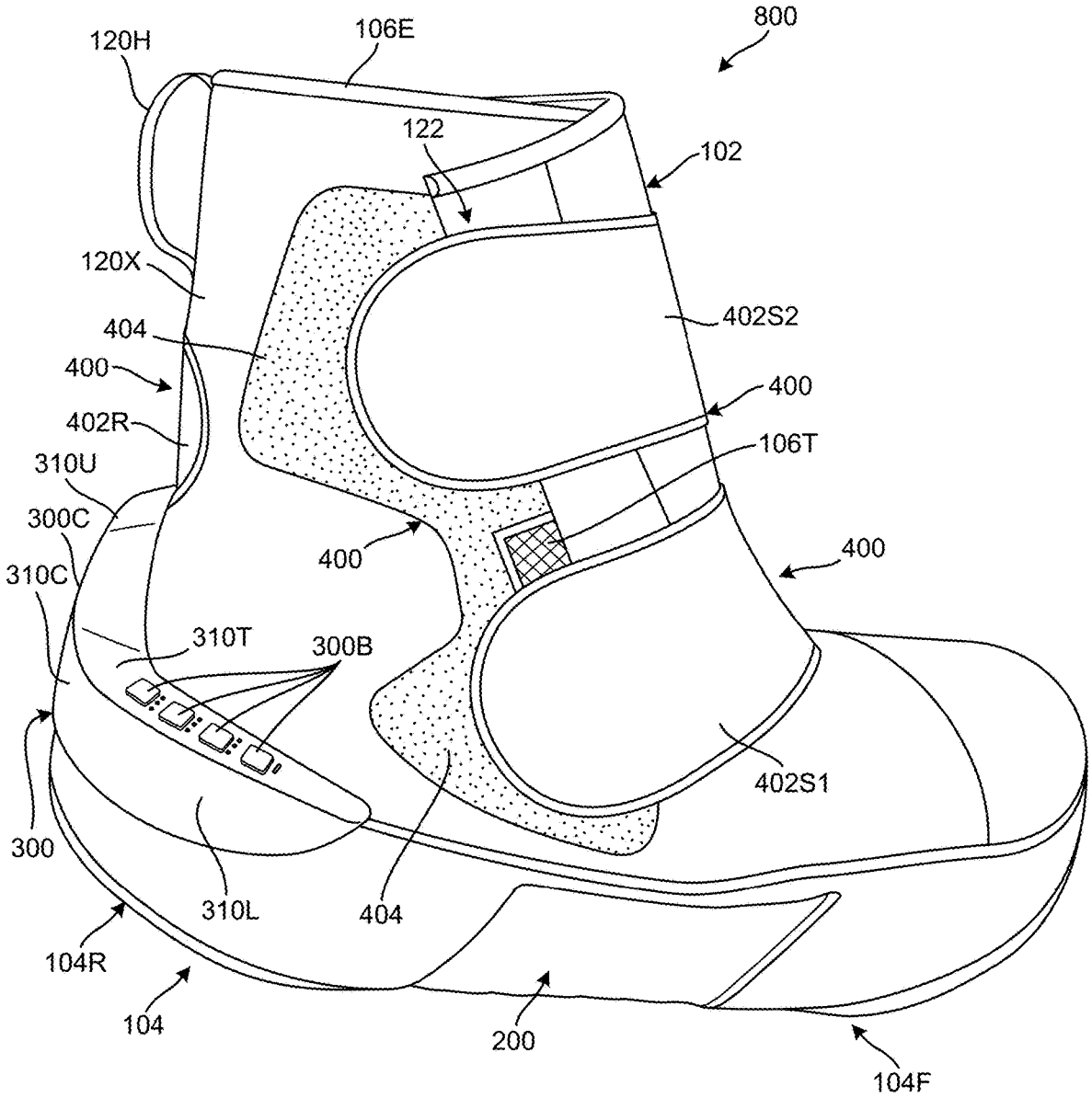
FIGS. 9A-9D provide various views of another example article of footwear in accordance with some aspects of this technology.
Figure 9C:
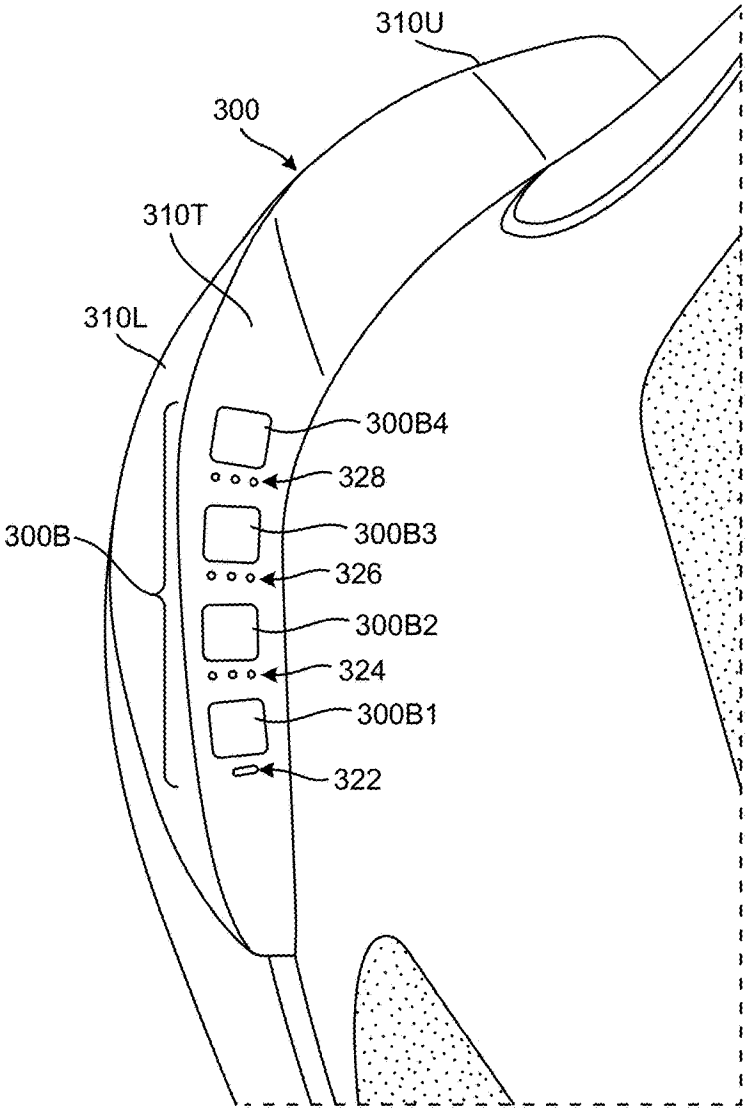
Figure 9B:
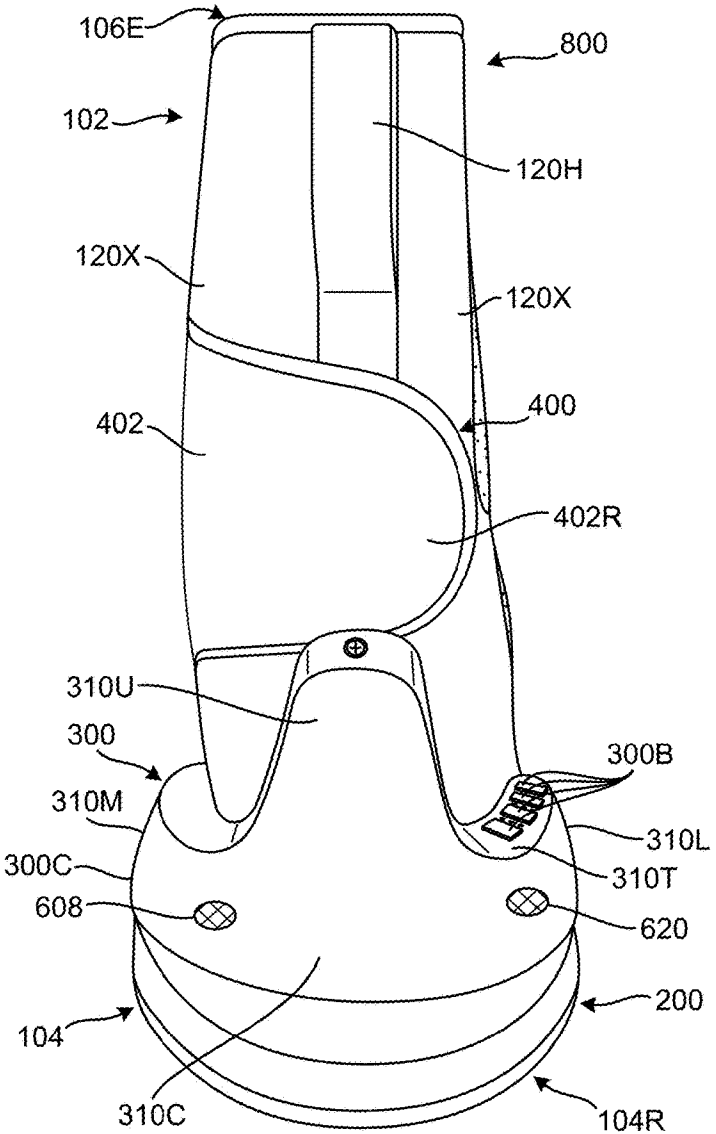
Figure 9D:
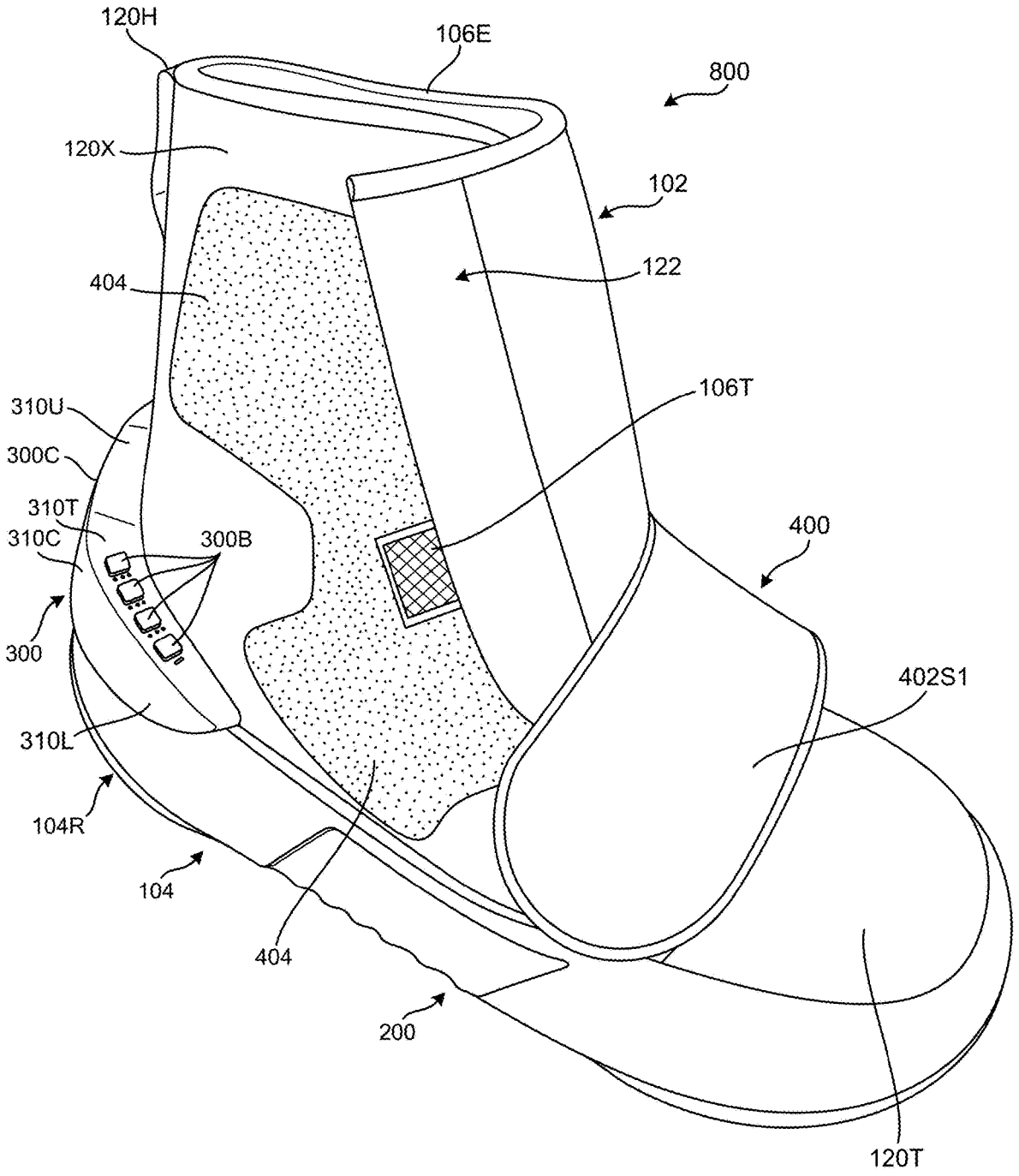

FIGS. 9A-9D provide various views of an alternative article of footwear 800 structure in accordance with some aspects of this technology. FIG. 9A provides a lateral side view of the article of footwear 800; FIG. 9B provides a rear heel view; FIG. 9C provides a close up view of the housing 300 including various input buttons 300B useful as part of an "input system;" and FIG. 9D provides a front, lateral perspective view. Second strap portion 402S2 is not shown in the view of FIG. 9D so that more of the footwear upper 102 and securing flap 122 remains visible (although a single strap portion (e.g., like 402S1 as shown in FIG. 9D) could be provided as the strap system 400 in some examples of this technology). Where the same reference numbers are used in FIGS. 9A-9D as used in FIGS. 2A-8B, the same or similar parts are being referenced, including all options or alternatives relating to that part, and much of the overlapping description may be omitted. Further, the input buttons 300B (and their functions) described below in conjunction with FIGS. 9A-9D also may be used with and/or applied to the input buttons 300B provided with the article of footwear 100 structures of FIGS. 2A-8B described above.

One difference between the article of footwear 800 of FIGS. 9A-9D and the article of footwear 100 of FIGS. 2A-2E relates to the absence of moderator component 312 at the rear heel area between the housing 300 and the exterior upper layer 120X (the example of FIGS. 2A-2E has the moderator component 312, the example of FIGS. 9A-9D does not). The moderator component 312 may be omitted, for example, if the footwear upper 102 (e.g., the interior upper layer 1201 and/or the exterior upper layer 120X) possesses sufficient moderator function (e.g., force attenuation, stiffness, cushioning, etc.) such that a separate moderator component 312 is not necessary and/or if the housing 300 itself is made from suitable materials (e.g., soft, flexible, etc.) such that further moderator function is not needed.

FIG. 9C further shows a close up view of an input system included with the housing 300 in accordance with some aspects of this technology. This example input system includes four input buttons 300B, e.g., in electrical communication with controller 630 (see FIG. 7A), which may be included within housing 300. More or fewer input buttons 300B may be provided and/or the buttons 300B may initiate additional and/or different functions from those described below. Additionally or alternatively, if desired, one or more input buttons 300B may be provided as "soft buttons," e.g., using a touch screen or touch panel affixed to the article of footwear 800 (e.g., affixed with one or more of the housing 300, footwear upper 102, sole structure 104, etc.). While other options are possible, in this specifically illustrated example, button 300B1 comprises a "power on/off" button and/or may be useful to check battery status (e.g., with status indicated by LED 322).

Interaction with button 300B2 may provide (e.g., toggle through) different levels of ankle/leg compression (e.g., by inflating bladder system 600 to various different pressures). As a more specific example: (a) one press of button 300B2 may cause controller 630 to produce a low pressure compressive force (a first pressure) using bladder system 600; (b) two presses of button 300B2 may cause controller 630 to produce a medium pressure compressive force (a second pressure) using bladder system 600; (c) three presses of button 300B2 may cause controller 630 to produce a high pressure compressive force (a third pressure) using bladder system 600; and (d) four presses of button 300B2 may toggle back to the first pressure setting (or to an "off" or "no pressure" setting); etc. In other examples of this technology, in addition or as an alternative to switching pressure settings by multiple button 300B2 presses, the amount of time button 300B2 is pressed could be used to toggle through the different pressure settings. As a more specific example: (i) a first pressure setting may be provided with an initial button 300B2 press, (ii) the system switches to a second pressure setting after a first time period while button 300B2 is held down (e.g., two seconds later), (iii) the system switches to a third pressure setting after a second time period while button 300B2 is held down (e.g., two additional seconds later), and (iv) the system switches back to the first pressure setting (or to an "off" or "no pressure" setting) after a third time period while button 300B2 is held down (e.g., two additional seconds later), In some examples, a series 324 of three LED indicators or other indicator configuration may be provided to display the selected compression level information.

Interaction with button 300B3 may provide (e.g., toggle through) different heating levels (e.g., using heating system 700). As a more specific example: (a) one press of button 300B3 may cause controller 630 to produce a low heating temperature using heating system 700; (b) two presses of button 300B3 may cause controller 630 to produce a medium heating temperature using heating system 700; (c) three presses of button 300B3 may cause controller 630 to produce a high heating temperature using heating system 700; and (d) four presses of button 300B3 may toggle back to the low temperature setting (or to an "off" setting); etc. In other examples of this technology, in addition or as an alternative to switching temperature settings by multiple button 300B3 presses, the amount of time button 300B3 is pressed could be used to toggle through the different temperature settings. As a more specific example: (i) a first temperature setting may be provided with an initial button 300B3 press, (ii) the system switches to a second temperature setting after a first time period while button 300B3 is held down (e.g., two seconds later), (iii) the system switches to a third temperature setting after a second time period while button 300B3 is held down (e.g., two additional seconds later), and (iv) the system switches back to the first temperature setting (or to an "off" setting) after a third time period while button 300B3 is held down (e.g., two additional seconds later), In some examples, a series 326 of three LED indicators or other indicator configuration may be provided to display the selected heating level information.

Interaction with button 300B4 may toggle between "pause" and "proceed" actions, with one or more LED indicators 328 or other indicator configuration providing status information of this button. The pause/play button 300B4 may allow a wearer to interrupt a treatment process (e.g., temporarily) without fully powering down the system and/or without having to completely restart the treatment process. In some examples of this technology, button 300B4 also could be used to completely stop a treatment process and/or to add additional time to an on-going treatment process (e.g., add two minutes), e.g., using a press and hold or other action. Many other functions, combinations of functions, and the like may be associated with the buttons 300B in other specific examples of this technology.

Figure 10:
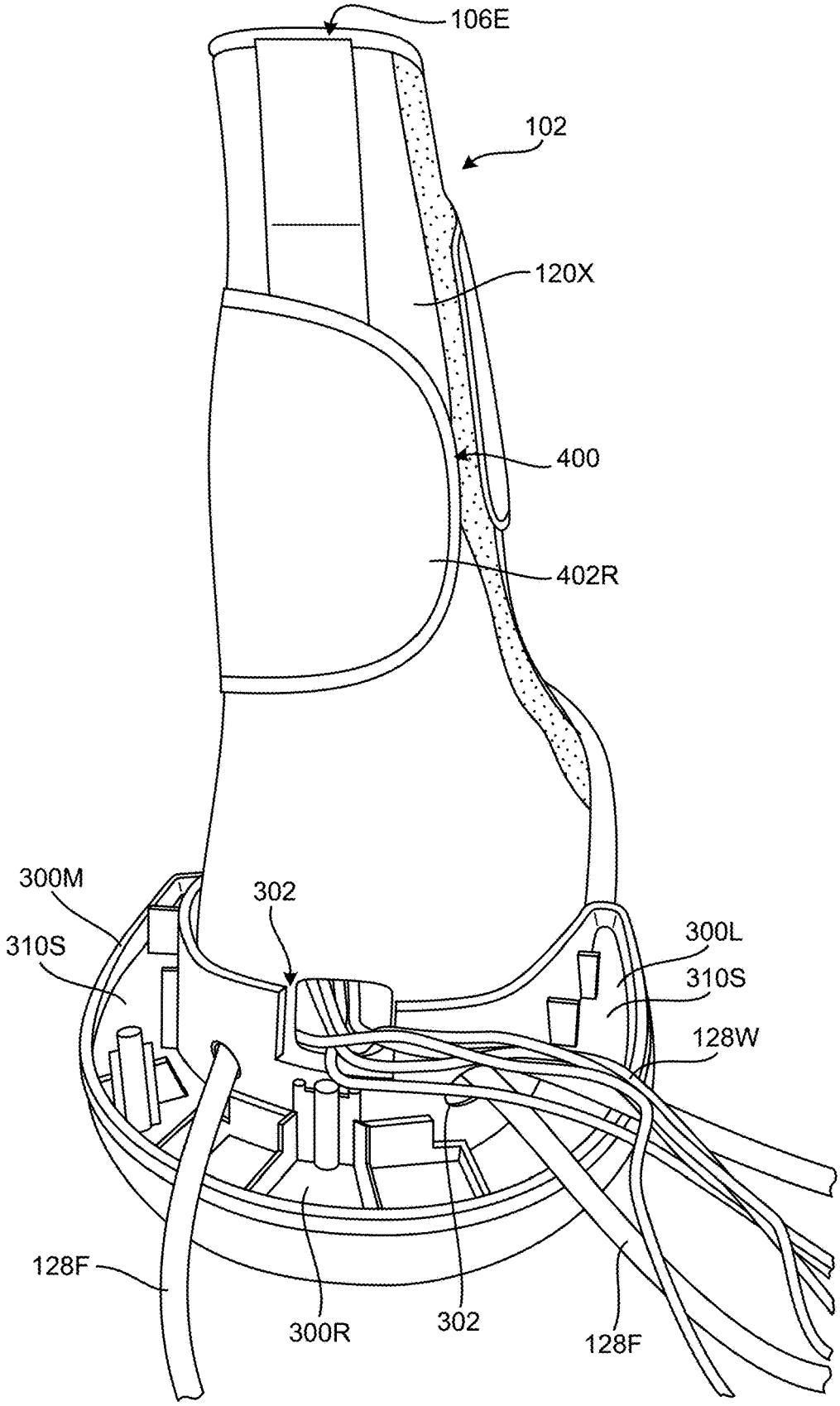
FIG. 10 illustrates a housing dock engaged with a footwear upper component that may be used in footwear components, articles of footwear, footwear systems, and methods in accordance with some examples of this technology.

FIGS. 4A and 4B show the housing 300's dock component 300D mounted to the rear heel area of a sole component (e.g., a midsole component 200 in this specific example). Other options are possible. For example, FIG. 10 shows the housing dock component 300D mounted to the rear heel area of a footwear upper 102. As shown, the footwear upper 102 and dock component 300D include openings through which fluid lines 128F and wires 128W can extend to engage other components of the system (such as portions of the fluid-filled bladder system 600 and the heating system 700 located between the interior upper layer 1201 and the exterior upper layer 120X as discussed above). This example dock component 300D includes a lateral arm 300L, a medial arm 300M, and a rear central portion 300R connecting the lateral arm 300L and the medial arm 300M. But, this example dock component 300D does not include an upwardly extending arm 304 like the example of FIGS. 4A and 4B (although one could be provided, if desired).

Figure 11A:
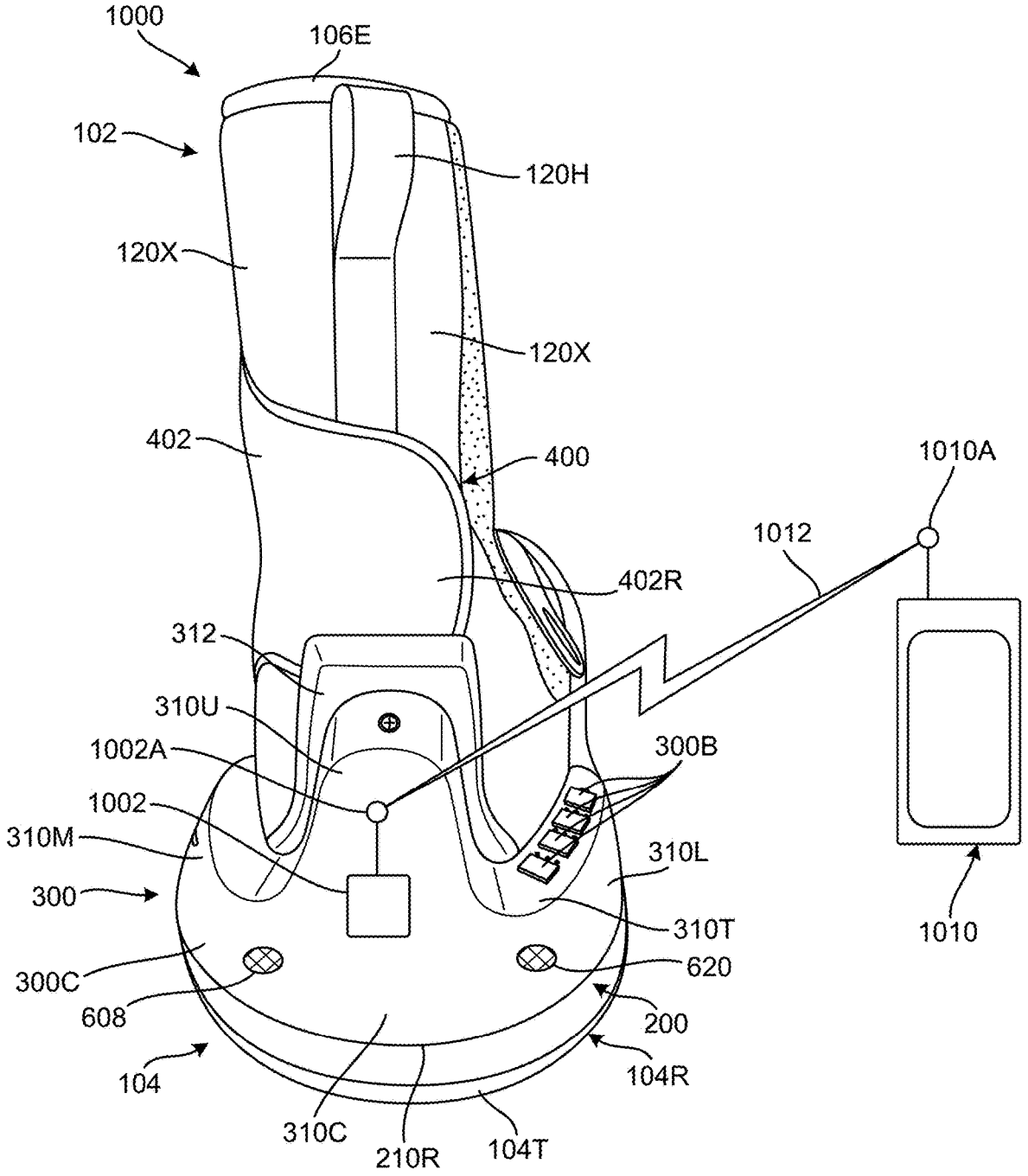
FIGS. 11A and 11B illustrate features of footwear systems including additional user input features in accordance with some examples of this technology.
Figure 11B:
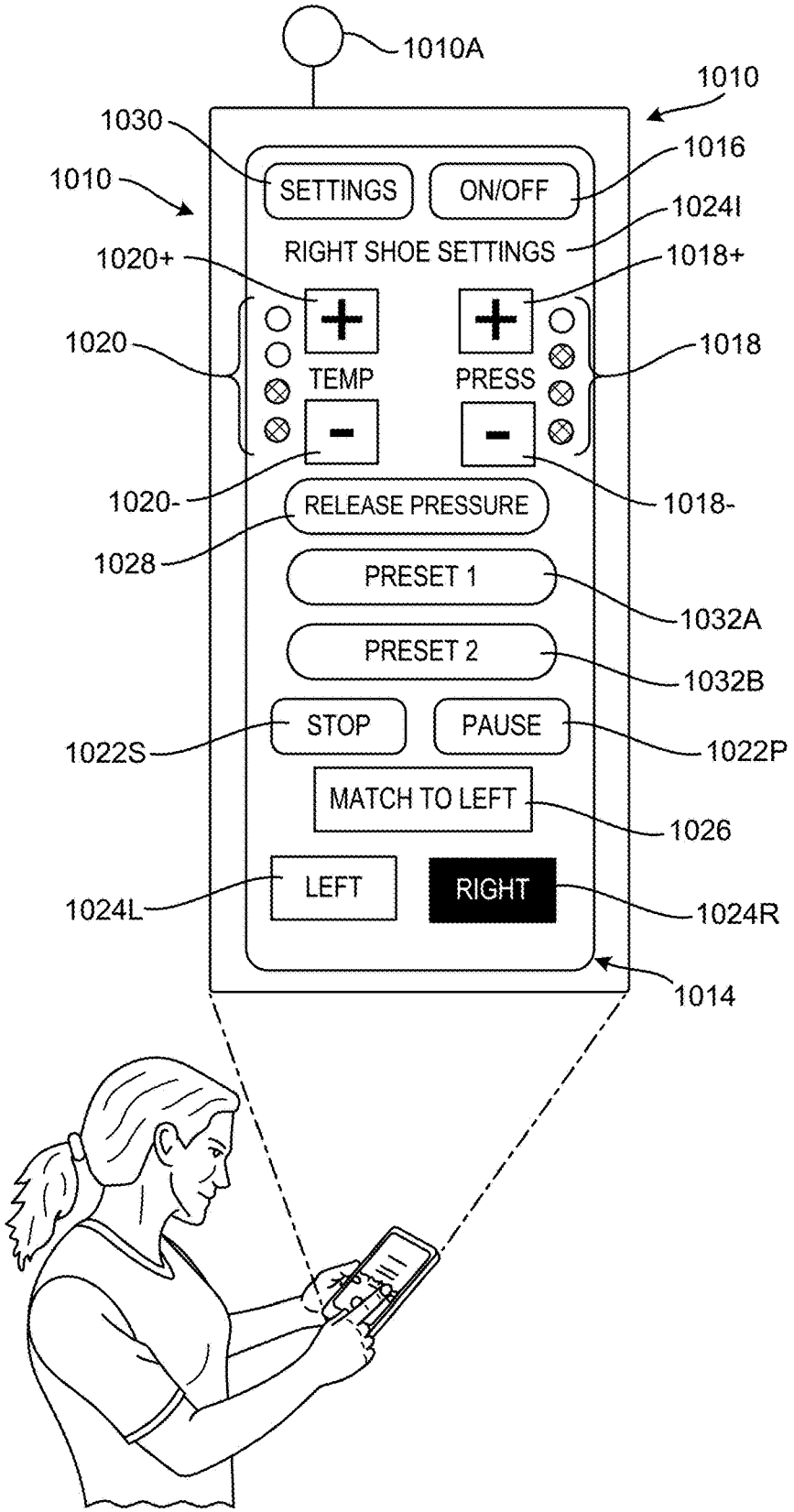

The example articles of footwear 100, 800 and footwear systems 650, 660 described above included physical buttons 300B as an input system used to receive user input for activating and controlling the compression system (e.g., fluid-filled bladder system 600 and fluid source component 610), the heating system 700, and/or the power source 500. FIGS. 11A and 11B illustrate additional input system features and/or alternative input system features to the physical button 300B input system described above. The footwear system 1000 of FIGS. 11A and 11B may include any and/or all of the features of the footwear structures and systems described above in conjunction with FIGS. 1-10.

In the example of FIGS. 11A and 11B, the footwear system 1000 includes an input system 1002 (e.g., including an antenna 1002A, one or more transceiver devices, one or more input ports (such as USB ports, plug receptacles, etc.), etc.) for receiving user input from a remote computing device 1010, such as a mobile or cellular telephone (e.g., a "smartphone" including an antenna 1010A). The input system 1002 may be in electronic communication with (and optionally provided as part of) electronic controller 630, e.g., shown in FIG. 7A. In this illustrated example, the remote computing device 1010 is in wireless communication with the input system 1002 (e.g., using any desired wireless transmission technology and/or communication protocols). See transmission icon 1012. As a more specific example, in at least some examples of this technology, the remote computing device 1010 may comprise a smartphone running a phone application program and communicating with the controller 630 through input system 1002 via a "BLUETOOTH" low energy ("BLE") communication system and/or protocol. Alternatively, in some examples of this technology, a wired connection may be used to transmit user input through input system 1002 to the controller 630.

In at least some examples of this technology, the input systems 1002 on two articles of footwear of a pair may be in communication with a remote computing device 1010 and/or the shoes of the pair may communicate with one another (e.g., via input systems 1002). Such types of communication features with a pair of shoes may be used to coordinate the application of compressive forces and/or the application of thermal treatments for the shoes of the pair. In other words, timing of treatment applied to a wearer's right foot may be controlled to coordinate with the timing of the treatment applied to the wearer's left foot. While the two treatment regimens for the wearer's two feet may be identical and in synch, this is not a requirement in all examples of this aspect of the present technology. Rather, in some examples of this technology, the treatments applied by the two shoes may be coordinated such that the treatments on each foot take place at a desired timing with respect to one another, but the two feet do not need to experience the exact same temperature and/or compressive force application conditions at the same time.

FIG. 11B illustrates examples of various functions and/or information that may be presented to a user on a graphical user interface screen 1014 and provided by an application program for receiving user input (e.g., for providing user input to controller 630). Similar to the buttons 300B, this application program (and its graphical user interface screen 1014) provides the user with the ability to: (a) power on/power off the system (soft button 1016); (b) the ability to raise or lower compression pressure (soft buttons 1018+, 1018−, with pressure level indicators 1018); (c) the ability to raise or lower temperature (soft buttons 1020+, 1020−, with temperature level indicators 1020); and (d) the ability to pause and/or stop a treatment process (soft buttons 1022P (for "pause") and 1022S (for "stop")). The graphical user interface screen 1014 of this example further includes soft buttons 1024L, 1024R to toggle between the graphical user interface screens 1014 for a left shoe and a right shoe as well as one or more indicators 1024I as to which shoe's information is being displayed. Additionally, the graphical user interface screen 1014 includes a shortcut (soft button 1026) to enable the user to match the settings for this shoe with the settings used on the other shoe. Additionally or alternatively, in at least some examples of this technology, the graphical user interface screen 1014 and/or compressive force treatment system and/or the thermal treatment system controlled through it may communicate with two shoes of a pair in a manner to coordinate the treatment processes in the two shoes, e.g., as described above.

Graphical user interfaces of this type may include other and/or different functions and information as well. For example, this graphical user interface screen 1014 includes a "Release Pressure" soft button 1028 that will immediately stop the system 1000 from introducing fluid into the fluid-filled bladder chamber(s) 602A, 602B and open valve 616. Soft button 1028 could be activated to quickly provide relief, e.g., if the user's foot, leg, and/or ankle is exposed to too much pressure and/or too high a temperature, and/or if the user otherwise needs to get out of the article of footwear 100, 800 in a rapid manner.

A "settings" soft button 1030 allows a user to access, change, and control various settings for the footwear system 1000, e.g., in conventional manners in which application programs enable "setting" changes. The "settings" button 1030 also may allow a user to enter, set, change, and control the treatment processes activated by the two "Preset" soft buttons 1032A and 1032B. The "Preset" soft buttons 1032A, 1032B (more or fewer may be provided) of this example will trigger the controller 630 to initiate a pre-selected compression and/or heating regimen for the wearer. The "Preset" soft buttons 1032A, 1032B may come pre-programmed with different compression and/or heating regimens (e.g., one for pre-game or pre-workout "warm up" and one for post-game or post-workout "cool down" or treatment). Additionally or alternatively, a user may be allowed to select from a list of potential pre-programmed regimens (e.g., available through the "settings" soft button 1030) and/or a user may be able to design a customized treatment regimen (e.g., with selectable temperature levels and/or pressure levels for different time periods and/or durations).

Figure 12:
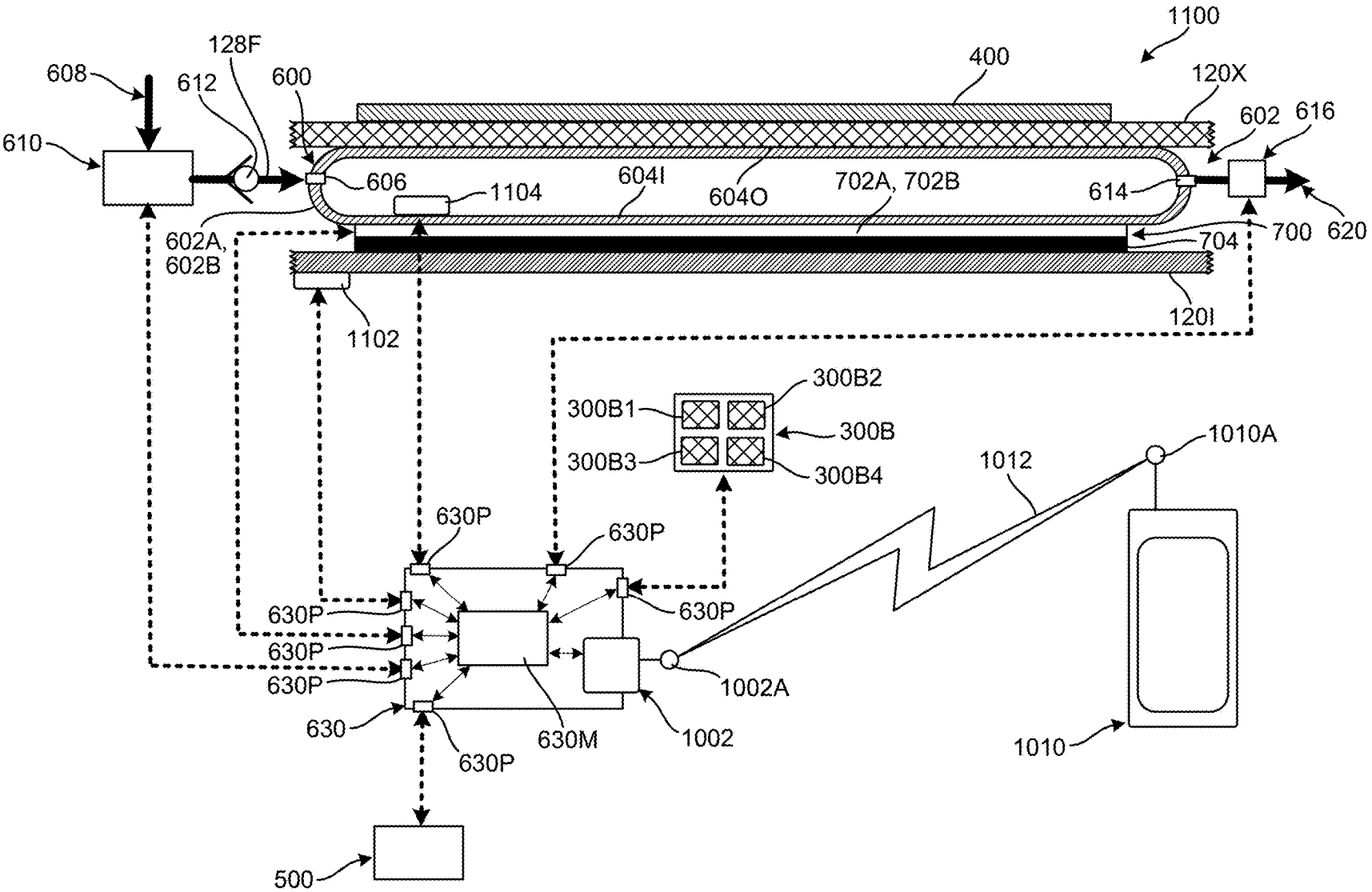
FIG. 12 illustrates features of footwear systems including additional sensor and user input features in accordance with some examples of this technology.

FIG. 12 provides a view of a footwear system 1100 similar to the footwear systems 650, 660 described above with respect to FIGS. 7A and 7B, but with some additional potential features, components, and/or functionality included. Where the same reference numbers are used in FIG. 12 as used in any of FIGS. 1-11B above, the same or similar parts are being referenced, including any of the options, alternatives, and/or variations described above, and much of the overlapping description may be omitted. Also, while FIG. 12 shows the additional features of FIG. 12 in combination with an "open" bladder system that intakes new air from and discharges air to the external environment, the additional features of FIG. 12 may be used in combination with a "closed system," of the types described above in conjunction with FIG. 7B. The footwear system 1100 of FIG. 12 may include wireless communication from a remote (e.g., mobile) computing device 1010 and/or a hard button 300B array, e.g., mounted directly on a housing 300 for an article of footwear 100, 800. Controller 630 receives user input (e.g., via buttons 300B and/or remote computing device 1010) and controls one or more of the fluid source component 610, the heating system 700, the power source 500, and/or the valve 616 to control the heat and/or compressive force applied to a wearer's foot, leg, and/or ankle, e.g., in the various manners described above. Thus, the footwear system 1100 of FIG. 12 may include any and/or all of the features of the footwear structures and systems described above in conjunction with FIGS. 1-11B.

FIG. 12 further shows that controller 630 includes various input/output ports 630P for receiving input and/or signals from and/or for sending output and/or signals to one or more of: (a) power source 500, (b) fluid source component 610, (c) heating system 700, (d) valve 616, and (c) and buttons 300B. The input/output ports 630P are in electronic communication with a processing system 630M (including one or more microprocessors) that performs desired computations on the input data and generates suitable outputs to be transmitted back to one or more of the power source 500, the fluid source component 610, the heating system 700, the valve 616, and/or the button 300B array. The same or a similar electronic controller 630 structure may be provided in the footwear systems 650 and 660 of FIGS. 7A and/or 7B.

The example footwear system 1100 of FIG. 12 may include one or more sensors that provide additional input data to the controller 630. This input data may be used to control operation of the footwear system 1100, e.g., to activate, deactivate, and/or modify certain processes and/or functions. As one more specific example, the interior of the ankle-containing chamber (or foot-receiving chamber 106) may include one or more sensors 1102 (e.g., mounted to interior upper layer 1201), such as a temperature sensor (e.g., to sense skin temperature or the temperature of the foot-receiving chamber 106), a sweat and/or moisture sensor, and/or a pressure or force sensor (e.g., to sense force being applied to a wearer's foot, leg, and/or ankle by the bladder system 600). Sensor 1102 may provide signals to (and receive signals from) electronic controller 630 via an input/output port 630P. Additionally or alternatively, the bladder system 600 (e.g., one or more of fluid chamber(s) 602A and/or 602B) may include a pressure sensor 1104 (e.g., to determine gas pressure in the bladder chamber(s) 602A and/or 602B). Sensor 1104 may provide signals to (and receive signals from) electronic controller 630 via another input/output port 630P. Data from the sensor(s) 1102 and/or 1104, when available, may be used to allow for "smart" control and/or automatic control of the heat and/or compression applied to a wearer's foot, leg, and/or ankle. As some more specific examples, data from sensor(s) 1102 and/or 1104 may be used as follows:

- to automatically slow or stop operation of fluid source component 610 if fluid pressure in the bladder system 600 as measured by sensor 1104 exceeds a threshold value;
- to automatically open valve 616 if fluid pressure in the bladder system 600 as measured by sensor 1104 exceeds a threshold value;
- to automatically slow or stop operation of fluid source component 610 if force or pressure sensor 1102 measures force applied to a wearer's foot, leg, and/or ankle above a threshold value;
- to automatically open valve 616 if force or pressure sensor 1102 measures force applied to a wearer's foot, leg, and/or ankle above a threshold value;
- to automatically stop or pause one or more of heating processes and/or compression (bladder inflation) processes if no foot is detected in the foot-receiving chamber 106;
- to automatically discontinue operation of heating elements 702A/702B if moisture sensor 1102 senses moisture in the foot-receiving chamber 106; and/or to automatically discontinue operation of heating elements 702A/702B if temperature sensor 1102 senses a temperature in the foot-receiving chamber 106 above a threshold value.

Other uses of the data from sensor(s) 1102 and/or 1104 also may be provided in other specific examples of this technology.

Additional aspects of this technology relate to methods of treating a foot, ankle, and/or leg of a wearer. Such methods may include: placing a foot, leg, and/or ankle in a foot-receiving chamber 106 of an article of footwear 100, 800, e.g., of any of the types described above (including any of the options, alternatives, or variations described above). Once inside, the foot, leg, and/or ankle may be secured in the foot-receiving chamber 106, e.g., by one or more of fastener system 124A and 124B for securing flap 122 and/or strap system 400 (e.g., to reduce or minimize space 712A discussed above). Then, controller 630 may activate the heating system 700 to apply heat to the foot, leg, and/or ankle and/or the fluid source component 610 to change fluid pressure in the fluid-filled bladder system 600. Heat and/or compressive force may be applied to the wearer's foot, leg, and/or ankle and modified over discrete time periods and/or over time intervals to apply a desired heat and/or compressive force treatment course to the wearer's leg, foot, and/or ankle. Different heat and/or pressure treatment courses may be used for different treatment purposes, such as: (i) warm up (for an athletic performance to be performed); (ii) cool down or recovery (from an athletic performance that has just been completed); (iii) long term recovery or treatment; (iv) injury treatment; (v) injury prevention; etc.

As noted above, in some examples of this technology, the fluid-filled bladder system 600 may include at least two distinct fluid chambers, e.g., lower fluid chamber 602A and upper fluid chamber 602B. In at least some treatment courses in accordance with this technology, fluid pressure in at least one of these fluid chambers 602A, 602B will be cycled between a relatively low pressure condition and a relatively high pressure condition (e.g., to apply a pulsating force to the wearer's foot, leg, and/or ankle). In some more specific examples of this technology, fluid pressure may be varied in lower fluid chamber 602A and upper fluid chamber 602B so that: (a) pressure is first low in both the lower fluid chamber 602A and upper fluid chamber 602B, (b) pressure is increased in the lower fluid chamber 602A, and (c) then pressure is increased in the upper fluid chamber 602B and, optionally, pressure is decreased in the lower fluid chamber 602A. Appropriate valving and/or switching systems may be provided to introduce fluid into and remove fluid from fluid chamber 602A and to introduce fluid into and remove fluid from fluid chamber 602B at the appropriate timing to provide the desired compressive force treatments at the different areas. Additionally or alternatively, in some examples of this technology: (a) pressure in a first chamber (e.g., lower fluid chamber 602A) can be increased at the same time that pressure in a second chamber is decreased (e.g., upper fluid chamber 602B) by moving fluid from the second chamber to the first chamber, and/or (b) pressure in the first chamber (e.g., lower fluid chamber 602A) can be decreased at the same time that pressure in the second chamber is increased (e.g., upper fluid chamber 602A) by moving fluid from the first chamber to the second chamber. In other words, one fluid chamber can act as a reservoir chamber for the other fluid chamber, and fluid can be moved back and forth between these two chambers to produce the compressive force pulsating action. Force applied in these manners can help push the compressive force (e.g., and thus the blood flow) upward on the wearer's leg. Thus, the pressure may be varied in fluid chambers 602A and 602B such that: during a first time period, fluid pressure in the lower fluid chamber 602A is greater than fluid pressure in the upper fluid chamber 602B, and (b) during another time period (e.g., later than the first time period), the fluid pressure in the upper fluid chamber 602B may be equal to or greater than the fluid pressure in the lower fluid chamber 602A. This pulsating action can be repeated over multiple cycles, e.g., to repeatedly apply the compressive force (and induce blood flow) in an upward direction in the wearer's leg. Additionally or alternatively, the pulsating action by the bladder system 600 can be cycled and applied (e.g., in any of the manners described above) to perform a massage type function on the wearer's heel, ankle, and/or leg region.

In accordance with at least some aspects of this technology, the article of footwear 100, 800 may be constructed for at least some conventional ambulatory activities, e.g., at least walking, jogging, for warm ups, etc. Thus, in such articles of footwear 100, 800, the sole structure 104 may be formed of materials and constructions that facilitate contact with the floor (or other contact surface), enable bending of the foot (e.g., to permit weight transfer from the heel to the toe as a wearer takes a conventional step), and/or otherwise support natural foot motion and flexion. Thus, the fluid-filled bladder system 600 and/or the heating system 700 may be limited to the heel, leg, and/or ankle areas (and/or to the portion of the footwear upper 102 corresponding to the "hightop" and "ankle-containing region" of a hightop footwear upper) and need not be included in the forefoot region of such footwear uppers and/or articles of footwear 100, 800. In this illustrated example, the fluid-filled bladder system 600 has its forwardmost extent located within the heel and/or midfoot region of the article of footwear 100 (e.g., located substantially in line with a forward edge of a wearer's leg when contained in the article of footwear 100). These features may keep the forefoot and forward toe region of the footwear uppers and articles of footwear 100, 800 relatively free and flexible (e.g., to better support ambulatory action in the footwear 100, 800).

As noted above, the "Preset" soft buttons 1032A, 1032B may come pre-programmed with different compression and heating treatment regimens, such as one for pre-game or pre-workout "warm up" and one for post-game or post-workout, "cool down," or other treatment. In some examples of this technology, the article of footwear 100, 800 may be worn and the warm-up compression and heating treatment programs may be activated while the wearer actually warms up immediately prior to the game and/or performance (e.g., optionally taking off the article of footwear 100, 800 immediately before the game and/or performance begins). "Preset" buttons of this type also may be provided as a hard or physical button (e.g., part of a button array, like one of buttons 300B1 to 300B4 shown in FIG. 9C).

Additional or alternative "preset" options may be available to the user. For example, predetermined or "preset" compression and/or heating treatment programs may be provided for different sports and/or different uses (e.g., a user could be prompted on graphical user interface screen 1014 to "select activity" from a list of activities, such as a list of sports). Systems and methods according to some examples of this technology may use the user input relating to the selected "activity" at least in part to develop and/or select a specific compression and/or heating treatment program to be applied to the user's foot, leg, and/or ankle.

As another example, systems and methods in accordance with at least some examples of this technology may receive user input (e.g., via graphical user interface screen 1014) indicating the difficulty or strenuousness of a workout, game, and/or other performance. The systems and/or methods may use this user input information to develop and/or select a specific compression and/or heating treatment program based, at least in part, on the difficulty or strenuousness input (e.g., with longer treatment times, higher temperatures, and/or different compression protocols selected for more difficult and/or strenuous workouts or performances).

Also, while the description above focuses on applying heat via heating system 700, at least some examples of this technology may additionally or alternatively include a cooling system for cooling the wearer's foot, leg, and/or ankle. In such systems, rather than or in addition to heating elements and one or more heating zones 702A and/or 702B, cooling elements and/or cooling zones may be provided. Cooling may be provided, for example, by coolant lines provided on a base member (e.g., a coolant fluid may be pumped through coolant lines). An additional layer of fabric or other material, such as fabric or material 704 layer, may be provided over the layer of the cooling system. This additional layer of fabric or other material (like material 704 layer) may be placed between the wearer's foot, leg, and/or ankle and the cooling elements to spread out and/or moderate the feel of the cooling elements on the wearer's foot, leg, and/or ankle.

CONCLUSION

The present technology is disclosed above and in the accompanying drawings with reference to a variety of embodiments. The purpose served by the disclosure, however, is to provide an example of the various features and concepts related to this technology, not to limit the scope of the claimed invention. One skilled in the relevant art will recognize that numerous variations and modifications may be made to the embodiments described above without departing from the scope of the presently claimed invention, as defined by the appended claims.

For the avoidance of doubt, the present application includes at least the subject matter described in the following numbered Clauses:

Clause 1. A footwear upper, comprising:
- an interior upper layer formed from one or more interior upper component parts;
- an exterior upper layer formed from one or more exterior upper component parts and engaged with the interior upper layer, wherein the interior upper layer and the exterior upper layer define an ankle-receiving chamber of the footwear upper;
- a fluid-filled bladder system including a first fluid chamber located between the interior upper layer and the exterior upper layer;
- a heating system having at least a portion engaged with the first fluid chamber;
- a fluid source component in fluid communication with the first fluid chamber and configured to supply fluid to the first fluid chamber;
- a power source for supplying power to at least the heating system; and
- a securing system for releasably securing the footwear upper to a wearer's foot, leg, and/or ankle (e.g., wherein the footwear upper and/or the fluid-filled bladder system will extend at least partially around or wrap at least partially around a circumference of a wearer's ankle and/or leg).

Clause 2. The footwear upper according to Clause 1, wherein the interior upper layer has a first stretchability level and the exterior upper layer has a second stretchability level, wherein the first stretchability level is greater than the second stretchability level; and/or
- wherein the interior upper layer has a first stiffness level and the exterior upper layer has a second stiffness level, wherein the second stiffness level is greater than the first stiffness level.

Clause 3. The footwear upper according to Clause 1 or 2, wherein each of the interior upper layer and the exterior upper layer extends to form a lateral ankle-containing region, a rear ankle-containing region, and a medial ankle-containing region.

Clause 4. The footwear upper according to Clause 1 or 2, wherein each of the interior upper layer and the exterior upper layer extends to close the ankle-receiving chamber when the securing system places the footwear upper in a closed configuration.

Clause 5. The footwear upper according to Clause 1 or 2, wherein each of the interior upper layer, the first fluid chamber, and the exterior upper layer extends to form a lateral ankle-containing region, a rear ankle-containing region, and a medial ankle-containing region.

Clause 6. The footwear upper according to Clause 1 or 2, wherein each of the interior upper layer, the first fluid chamber, and the exterior upper layer extends to close the ankle-receiving chamber when the securing system places the footwear upper in a closed configuration.

Clause 7. The footwear upper according to any one of Clauses 1 to 6, wherein the securing system includes a first strap member secured to at least one of the interior upper layer or the exterior upper layer, and a first strap securing member secured to at least one of the interior upper layer or the exterior upper layer.

Clause 8. The footwear upper according to Clause 7, wherein the first strap securing member includes a first portion of a hook-and-loop fastener, and wherein the first strap member includes a second portion of the hook-and-loop fastener.

Clause 9. The footwear upper according to Clause 7, wherein the first strap securing member includes a first portion of a hook-and-loop fastener system, and wherein the first strap member includes: (i) a first strap portion having a second portion of the hook-and-loop fastener system and (ii) a second strap portion having a third portion of the hook-and-loop fastener system.

Clause 10. The footwear upper according to Clause 7, wherein the first strap member includes: (i) a first side base portion, (ii) a rear heel portion extending from the first side base portion at least to a rear heel region of the footwear upper, and (iii) a first strap portion extending from the first side base portion at least around a forward ankle region of the footwear upper.

Clause 11. The footwear upper according to Clause 7, wherein the first strap member includes: (i) a first side base portion, (ii) a rear heel portion extending from the first side base portion at least to a rear heel region of the footwear upper, (iii) a first strap portion extending from the first side base portion at least around a forward ankle region of the footwear upper, and (iv) a second strap portion extending from the first side base portion and spaced upward on the footwear upper from the first strap portion.

Clause 12. The footwear upper according to Clause 10 or 11, wherein the first side base portion is located at a medial side of the footwear upper.

Clause 13. The footwear upper according to any one of Clauses 7 to 12, wherein the first strap securing member is engaged with an exterior surface of the exterior upper layer.

Clause 14. The footwear upper according to Clause 13, wherein the first strap securing member comprises a portion of a hook-and-loop fastener element.

Clause 15. The footwear upper according to any one of Clauses 1 to 14, wherein the exterior upper layer includes a body portion having a first edge and a second edge opposite the first edge, wherein the body portion is oriented to extend around a rear heel portion of the footwear upper such that the first edge defines a forward foot-insertion opening edge of the footwear upper and the second edge extends at least to the forward foot-insertion opening edge when the securing system places the footwear upper in a closed configuration; and wherein in some examples, the second edge includes a pulling tab or other grip-enhancing element.

Clause 16. The footwear upper according to Clause 15, wherein at least a portion of the securing system is fixed to the exterior upper layer.

Clause 17. The footwear upper according to any one of Clauses 1 to 16, further comprising a housing, wherein at least a portion of one or more of the heating system, the fluid source component, and/or the power source is located in the housing.

Clause 18. The footwear upper according to any one of Clauses 1 to 16, further comprising a housing, wherein at least a portion of the fluid source component is located in the housing.

Clause 19. The footwear upper according to Clause 17 or 18, wherein the housing is engaged with the exterior upper layer at a rear heel region of the footwear upper.

Clause 20. The footwear upper according to any one of Clauses 17 to 19, wherein the housing includes a lateral arm, a medial arm, and a rear central portion connecting the lateral arm and the medial arm.

Clause 21. The footwear upper according to Clause 20, wherein the rear central portion includes an upwardly extending arm.

Clause 22. The footwear upper according to Clause 21, further comprising a moderator component located between the rear central portion and the exterior upper layer.

Clause 23. The footwear upper according to any one of Clauses 17 to 22, wherein the housing includes one or more user input buttons for controlling one or more of the heating system, the fluid source component, and/or the power source.

Clause 24. The footwear upper according to any one of Clauses 17 to 23, wherein the housing includes a vent port for venting heat generated by the power source.

Clause 25. The footwear upper according to any one of Clause 17 to 24, wherein the housing includes a dock part and a cover part that engages with the dock part to form a housing chamber.

Clause 26. The footwear upper according to any one of Clauses 1 to 25, wherein the fluid source component includes at least one of a pump or a compressor.

Clause 27. The footwear upper according to any one of Clauses 1 to 26, wherein the power source includes a battery.

Clause 28. The footwear upper according to any one of Clauses 1 to 27, wherein the first fluid chamber of the fluid-filled bladder system is changeable between a first pressure condition and a second pressure condition, wherein the second pressure condition is at a higher pressure than the first pressure condition, wherein changing the first fluid chamber from the first pressure condition to the second pressure condition is accompanied by displacement of interior upper layer toward a center of the ankle-receiving chamber.

Clause 29. The footwear upper according to any one of Clauses 1 to 28, further comprising an input system for receiving user input for controlling one or more of the heating system, the fluid source component, and/or the power source.

Clause 30. The footwear upper according to Clause 29, wherein the input system includes one or more buttons.

Clause 31. The footwear upper according to Clause 29, wherein the input system includes an antenna for receiving electronic input in a wireless manner.

Clause 32. The footwear upper according to any one of Clauses 1 to 31, wherein the fluid-filled bladder system includes a second fluid chamber, and wherein the fluid-filled bladder system is configured such that different fluid pressures are present in the first fluid chamber and the second fluid chamber at least during a first time period.

Clause 33. The footwear upper according to Clause 32, wherein the first fluid chamber is located lower on the footwear upper than the second fluid chamber.

Clause 34. The footwear upper according to any one of Clauses 1 to 33, wherein the heating system includes a first heating element and a second heating element.

Clause 35. The footwear upper according to Clause 34, wherein the first heating element is located lower on the footwear upper than the second heating element.

Clause 36. The footwear upper according to any one of Clauses 1 to 35, further comprising an electronic control system for controlling one or more of the heating system, the fluid source component, and/or the power source.

Clause 37. An article of footwear, comprising:

a sole structure; and a footwear upper according to any one of Clauses 1 to 36 engaged with the sole structure.

Clause 38. The article of footwear according to Clause 37, wherein at least a portion of the power source is engaged with the sole structure.

Clause 39. The article of footwear according to Clause 37, wherein the sole structure includes a midsole component, and wherein the power source is engaged with the midsole component.

Clause 40. The article of footwear according to Clause 39, wherein the midsole component includes a top surface having a recess defined therein, and wherein at least a portion of the power source is received in the recess.

Clause 41. The article of footwear according to Clause 40, wherein the top surface of the midsole component further includes a channel that extends from the recess to a rear heel portion of the midsole component.

Clause 42. The article of footwear according to any one of Clauses 38 to 41, wherein a bottom surface of the sole structure includes one or more vent openings that open into a chamber into which the portion of the power source is received.

Clause 43. The article of footwear according to any one of Clauses 38 to 41, wherein the sole structure includes one or more vent channels that open into a chamber into which the portion of the power source is received and extend to a location exterior to the sole structure.

Clause 44. A sole structure for an article of footwear, comprising:

a sole component, wherein a recess is defined in the sole component, wherein one or more vents are defined in a material of the sole component, the one or more vents including: (i) one or more through hole openings extending from the recess to an exterior surface of the sole component and/or (ii) one or more elongated channels defined in a material of the sole component and extending from the recess to the exterior surface of the sole component; and a power source at least partially received in the recess.

Clause 45. The sole structure according to Clause 44, wherein the sole component includes a midsole component formed at least in part from a polymer foam material, wherein the recess is defined in the polymer foam material.

Clause 46. The sole structure according to Clause 45, wherein the midsole component includes a top surface having the recess defined therein.

Clause 47. The sole structure according to Clause 46, wherein the top surface of the midsole component further includes a channel that extends from the recess to a rear heel portion of the midsole component.

Clause 48. The sole structure according to any one of Clauses 44 to 47, wherein the one or more vents include the one or more through hole openings extending from the recess to the exterior surface of the sole component.

Clause 49. The sole structure according to Clause 48, wherein the exterior surface of the sole component is a bottom exterior surface of the sole component.

Clause 50. The sole structure according to any one of Clauses 44 to 49, wherein the one or more vents include the one or more elongated channels defined in the material of the sole component and extending from the recess to the exterior surface of the sole component.

Clause 51. The sole structure according to Clause 50, wherein the one or more elongated channels are defined in a top surface of the sole component.

Clause 52. The sole structure according to any one of Clauses 44 to 51, further comprising a housing component engaged with the sole component.

Clause 53. The sole structure according to Clause 52, wherein the housing component is engaged at a rear heel area of the sole component.

Clause 54. The sole structure according to Clause 52 or 53, wherein the housing component includes a lateral arm, a medial arm, and a rear central portion connecting the lateral arm and the medial arm.

Clause 55. The sole structure according to Clause 54, wherein the rear central portion includes an upwardly extending arm.

Clause 56. The sole structure according to any one of Clause 52 to 55, wherein the housing component includes a dock part, wherein the dock part is engageable with a cover part to form a housing chamber.

Clause 57. The sole structure according to Clause 56, wherein the housing chamber includes one or more user input buttons for controlling one or more of power, heat, and/or compressive force generated by one or more footwear components associated with the sole structure.

Clause 58. The sole structure according to any one of Clauses 52 to 57, wherein the housing component includes an outlet port for venting heat generated by the power source.

Clause 59. An article of footwear, comprising:

a footwear upper according to any one of Clauses 1 to 36; and a sole structure according to any one of Clauses 44 to 58 engaged with the footwear upper.

Clause 60. A footwear system for applying heat and/or pressure to a wearer's foot, leg, and/or ankle, the footwear system comprising:

a footwear upper according to any one of Clauses 1 to 36;

a sole structure according to any one of Clauses 44 to 58 engaged with the footwear upper; and an electronic control system engaged with at least one of the footwear upper and the sole structure, the electronic control system being configured to control the heat and/or pressure applied to the wearer's foot, leg, and/or ankle.

Clause 61. The footwear system according to Clause 60, further comprising an electronic computing device in communication with the electronic control system to provide user input to the electronic control system.

Clause 62. The footwear system according to Clause 61, wherein the electronic computing device is in wireless communication with the electronic control system.

Clause 63. The footwear system according to Clause 61 or 62, wherein the electronic computing device is configured to display information identifying one or more heat and/or pressure treatment regimens for user selection as potential user input.

Clause 64. The footwear system according to any one of Clauses 61 to 63, wherein the user input relates to one or more of: a change in temperature to be generated by the heating system; a change in fluid pressure to be provided in the fluid-filled bladder system; a stop command; and a pause command.

Clause 65. The footwear system according to any one of Clauses 60 to 64, wherein the electronic control system includes one or more buttons configured to activate one or more functions of the footwear system.

Clause 66. A method of treating a foot, ankle, and/or leg, comprising:

placing a foot, leg, and/or ankle in an interior chamber of an article of footwear according to any one of Clauses 37 to 43 or 59;

securing the footwear upper to the foot, leg, and/or ankle using the securing system (e.g., wherein the footwear upper and/or the fluid-filled bladder system will extend at least partially around or wrap at least partially around a circumference of a wearer's ankle and/or leg);

powering the heating system to apply heat to the foot, leg, and/or ankle; and powering the fluid source component to change fluid pressure in the fluid-filled bladder system.

Clause 67. The method according to Clause 66, wherein the fluid pressure in the first fluid chamber is cycled between a low pressure condition and a high pressure condition.

Clause 68. The method according to Clause 66 or 67, wherein the fluid-filled bladder system includes a second fluid chamber, and wherein the fluid source component is controlled such that, during at least some time periods, different fluid pressures are present in the first fluid chamber and the second fluid chamber.

Clause 69. The method according to Clause 68, wherein the first fluid chamber is located lower on the footwear upper than the second fluid chamber.

Clause 70. The method according to Clause 68 or 69, wherein during a first time period, fluid pressure in the first fluid chamber is greater than fluid pressure in the second fluid chamber, and wherein during a second time period later than the first time period, the fluid pressure in the second fluid chamber is equal to or greater than the fluid pressure in the first fluid chamber.

Clause 71. The method according to any one of Clauses 66 to 70, further comprising receiving user input relating to one or more of: a change in temperature to be generated by the heating system; a change in the fluid pressure to be provided in the fluid-filled bladder system; a stop command; and a pause command.

Clause 72. The method according to any one of Clauses 66 to 71, further comprising receiving user input indicating a desired heat/pressure treatment regimen to be performed.

Clause 73. The method according to Clause 72, wherein the desired heat/pressure treatment regimen to be performed is selected by a user from a list of two or more pre-programmed heat/pressure treatment regimens.

Clause 74. An article of footwear, comprising:

a sole structure;

a footwear upper engaged with the sole structure, wherein the footwear upper includes: (i) a fluid-filled bladder system including a first fluid chamber zone and a second fluid chamber zone, and (ii) a securing system for releasably securing the footwear upper to a wearer's foot, leg, and/or ankle (e.g., wherein the footwear upper and/or the fluid-filled bladder system will extend at least partially around or wrap at least partially around a circumference of a wearer's ankle and/or leg);

a fluid transfer system configured to move fluid: (a) into and out of the first fluid chamber zone, (b) into and out of the second fluid chamber zone, and (c) in a manner to cyclically and sequentially increase pressure and decrease pressure in each of the first fluid chamber zone and the second fluid chamber zone; and a power source for supplying power to the fluid transfer system.

Clause 75. The article of footwear according to Clause 74, wherein the second fluid chamber zone is located rearward in the article of footwear with respect to the first fluid chamber zone.

Clause 76. The article of footwear according to Clause 75, wherein the fluid-filled bladder system includes a third fluid chamber zone located upward in the article of footwear with respect to the second fluid chamber zone, and wherein the fluid transfer system further is configured to move fluid into and out of the third fluid chamber zone and in a manner to cyclically and sequentially increase pressure and decrease pressure in the third fluid chamber zone.

Clause 77. The article of footwear according to Clause 74, wherein the second fluid chamber zone is located upward in the article of footwear with respect to the first fluid chamber zone.

Clause 78. The article of footwear according to any one of Clauses 74 to 77, wherein the fluid transfer system further is configured to move fluid such that: (A) at a first time: (i) the first fluid chamber zone is at a first pressure condition and (ii) the second fluid chamber zone is at a second pressure condition, wherein the first pressure condition is at a higher pressure than the second pressure condition; and (B) at a second time that is after the first time: (i) the first fluid chamber zone is at a third pressure condition and (ii) the second fluid chamber zone is at a fourth pressure condition, wherein the fourth pressure condition is at a higher pressure than the third pressure condition.

Clause 79. The article of footwear according to Clause 78, wherein the fluid transfer system further is configured to move fluid such that at a third time that is after the second time: (i) the first fluid chamber zone is at a fifth pressure condition and (ii) the second fluid chamber zone is at a sixth pressure condition, wherein the fifth pressure condition is at a higher pressure than the sixth pressure condition.

Clause 80. The article of footwear according to Clause 79, wherein the fluid transfer system further is configured to move fluid such that at a fourth time that is after the third time: (i) the first fluid chamber zone is at a seventh pressure condition and (ii) the second fluid chamber zone is at an eighth pressure condition, wherein the eighth pressure condition is at a higher pressure than the seventh pressure condition.

Clause 81. The article of footwear according to any one of Clauses 74 to 77, wherein the fluid transfer system further is configured to move fluid such that during a first time period: (i) the first fluid chamber zone changes from a first pressure condition to a second pressure condition, wherein the first pressure condition is at a higher pressure than the second pressure condition; and (B) the second fluid chamber zone changes from a third pressure condition to a fourth pressure condition, wherein the fourth pressure condition is at a higher pressure than the third pressure condition.

Clause 82. The article of footwear according to Clause 81, wherein the fluid transfer system further is configured to move fluid such that during at least a portion of the first time period, fluid is moving to change the first fluid chamber zone from the first pressure condition to the second pressure condition while fluid is moving to change the second fluid chamber zone from the third pressure condition to the fourth pressure condition.

Clause 83. The article of footwear according to Clause 81 or 82, wherein the fluid transfer system further is configured to move fluid such that during a second time period after the first time period: (i) the first fluid chamber zone changes from the second pressure condition to a fifth pressure condition, wherein the fifth pressure condition is at a higher pressure than the second pressure condition; and (B) the second fluid chamber zone changes from the fourth pressure condition to a sixth pressure condition, wherein the fourth pressure condition is at a higher pressure than the sixth pressure condition.

Clause 84. The article of footwear according to Clause 83, wherein the fluid transfer system further is configured to move fluid such that during at least a portion of the second time period, fluid is moving to change the first fluid chamber zone from the second pressure condition to the fifth pressure condition while fluid is moving to change the second fluid chamber zone from the fourth pressure condition to the sixth pressure condition.

What is claimed is:

1. An article of footwear, comprising:

a sole structure;

a footwear upper engaged with the sole structure, wherein the footwear upper includes: (i) an interior upper layer formed from one or more interior upper component parts, (ii) an exterior upper layer formed from one or more exterior upper component parts and engaged with the interior upper layer, wherein the interior upper layer and the exterior upper layer define an ankle-containing chamber of the footwear upper, (iii) a fluid-filled bladder system including a first fluid chamber located between the interior upper layer and the exterior upper layer, and (iv) a securing system for releasably securing the footwear upper to a wearer's foot such that the footwear upper is configured to wrap around a wearer's ankle;

a fluid source component in fluid communication with the first fluid chamber and configured to supply fluid to the first fluid chamber; and a power source for supplying power to the fluid source component for changing fluid pressure in the first fluid chamber; and a housing, wherein at least a pump or compressor component of the fluid source component is located in the housing, and wherein the housing is mounted on a rim of the sole structure that extends outward beyond the exterior upper layer at a heel portion of the article of footwear.

2. The article of footwear according to claim 1, wherein at least a portion of the power source is engaged with the sole structure.

3. The article of footwear according to claim 1, wherein the sole structure includes a midsole component, and wherein the power source is included with the midsole component.

4. The article of footwear according to claim 3, wherein the midsole component includes a top surface having a recess defined therein, and wherein at least a portion of the power source is received in the recess.

5. The article of footwear according to claim 4, wherein the top surface of the midsole component further includes a channel that extends from the recess to a heel portion of the midsole component, wherein the pump or compressor component of the fluid source component is located at the heel portion of the article of footwear, and wherein wiring extends along the recess and is coupled to the power source and to the pump or compressor component.

6. The article of footwear according to claim 1, further comprising a foam moderator component positioned between and fixed to each of an interior surface of the housing and the exterior upper layer.

7. The article of footwear according to claim 1, wherein the footwear upper includes a body portion that extends from a first edge to a second edge located opposite the first edge, wherein the body portion is oriented to extend around and form a rear heel portion of the footwear upper such that the first edge defines a forward foot-insertion opening edge of the footwear upper and the second edge extends at least to the forward foot-insertion opening edge when the securing system places the footwear upper in a closed configuration, and wherein the securing system includes: (i) a first fastener component located at the first edge, (ii) a second fastener component located at a second edge, wherein the first fastener component releasably engages the second fastener component to secure the article of footwear to the wearer's foot, and (iii) a grip element located at the second edge.

8. The article of footwear according to claim 1, further comprising a foam moderator component positioned between the housing and the exterior upper layer.

9. An article of footwear, comprising:

a sole structure:

a footwear upper engaged with the sole structure, wherein the footwear upper includes: (i) an interior upper layer formed from one or more interior upper component parts, (ii) an exterior upper layer formed from one or more exterior upper component parts and engaged with the interior upper laver, wherein the interior upper layer and the exterior upper layer define an ankle-containing chamber of the footwear upper, (iii) a fluid-filled bladder system including a first fluid chamber located between the interior upper layer and the exterior upper layer, and (iv) a securing system for releasably securing the footwear upper to a wearer's foot such that the footwear upper is configured to wrap around a wearer's ankle;

a fluid source component in fluid communication with the first fluid chamber and configured to supply fluid to the first fluid chamber;

a power source for supplying power to the fluid source component for changing fluid pressure in the first fluid chamber;

a housing, wherein at least a pump or compressor component of the fluid source component is located in the housing; and a foam moderator component positioned between the housing and the exterior upper layer.

10. The article of footwear according to claim 9, wherein the housing is mounted on a rim of the sole structure that extends outward beyond the exterior upper layer at a heel portion of the article of footwear.

11. An article of footwear, comprising:

a footwear upper that includes: (i) a fluid-filled bladder system including a first fluid chamber, (ii) a temperature controlling system, and (iii) a securing system for releasably securing the footwear upper to a wearer's foot;

a sole component engaged with the footwear upper, the sole component including an outer perimeter rim located outwardly beyond an exterior surface of the footwear upper at a heel area of the article of footwear to provide a top surface portion of the sole component outside of the footwear upper at the heel area of the article of footwear, wherein a recess is defined in the sole component, wherein one or more vents are defined in a material of the sole component, the one or more vents including one or more elongated channels defined in a material of the sole component and extending from the recess to the top surface portion of the sole component located outside of the footwear upper at the heel area of the article of footwear; and a power source at least partially received in the recess for supplying power to the temperature controlling system, wherein wiring connected to the power source extends through a first elongated channel of the one or more elongated channels to the top surface portion.

12. The article of footwear according to claim 11, wherein the sole component includes a midsole component formed at least in part from a polymer foam material, wherein the recess and the first elongated channel are defined in the polymer foam material.

13. The article of footwear according to claim 12, wherein the midsole component includes a top surface that forms the top surface portion of the sole component located outside of the footwear upper at the heel area of the article of footwear, wherein the top surface further has the recess and the first elongated channel defined therein.

14. The article of footwear according to claim 12, wherein the one or more elongated channels are defined in a top surface of the midsole component, and wherein the top surface of the midsole component extends to form the top surface portion of the sole component located outside of the footwear upper at the heel area of the article of footwear.

15. The article of footwear according to claim 11, further comprising a housing engaged with the top surface portion of the sole component at the heel area of the article of footwear.

16. The article of footwear according to claim 15, further comprising a foam moderator component positioned between the housing and the footwear upper.

17. The article of footwear according to claim 11, wherein the footwear upper includes a body portion that extends from a first edge to a second edge located opposite the first edge, wherein the body portion is oriented to extend around and form a rear heel portion of the footwear upper such that the first edge defines a forward foot-insertion opening edge of the footwear upper and the second edge extends at least to the forward foot-insertion opening edge when the securing system places the footwear upper in a closed configuration, and wherein the securing system includes: (i) a first fastener component located at the first edge, and (ii) a second fastener component located at a second edge, wherein the first fastener component releasably engages the second fastener component to secure the article of footwear to the wearer's foot.

18. An article of footwear, comprising:

a sole structure including a midsole component having a top surface and a bottom surface, wherein a recess is defined in the top surface, and wherein a channel is formed in the top surface, the channel extending from the recess toward a perimeter heel area of the midsole component;

a footwear upper engaged with the sole structure, wherein the footwear upper includes: (i) an interior upper layer formed from one or more interior upper component parts, (ii) an exterior upper layer formed from one or more exterior upper component parts and engaged with the interior upper layer, wherein the interior upper layer and the exterior upper layer define an ankle-containing chamber of the footwear upper, (iii) a fluid-filled bladder system including a first fluid chamber located between the interior upper layer and the exterior upper layer, and (iv) a securing system for releasably securing the footwear upper to a wearer's foot such that the footwear upper wraps around a wearer's ankle;

a fluid source component in fluid communication with the first fluid chamber and configured to supply fluid to the first fluid chamber;

a housing engaged with the top surface of the midsole component at a heel region of the article of footwear, wherein at least a first portion of the fluid source component is located in the housing;

a foam moderator component located between an interior surface of the housing and the exterior upper layer; and a power source for supplying power to the fluid source component for changing fluid pressure in the first fluid chamber, wherein the power source is received in the recess and wiring from the power source extends along the channel and connects with the first portion of the fluid source component to supply power to the fluid source component.

19. The article of footwear according to claim 18, wherein the footwear upper includes a body portion that extends from a first edge to a second edge located opposite the first edge, wherein the body portion is oriented to extend around and form a rear heel portion of the footwear upper such that the first edge defines a forward foot-insertion opening edge of the footwear upper and the second edge extends at least to the forward foot-insertion opening edge when the securing system places the footwear upper in a closed configuration, and wherein the securing system includes: (i) a first fastener component located at the first edge, (ii) a second fastener component located at a second edge, wherein the first fastener component releasably engages the second fastener component to secure the article of footwear to the wearer's foot, and (iii) a grip element located at the second edge.

20. The article of footwear according to claim 18, wherein the housing is mounted on a rim of the sole structure that extends outward beyond the exterior upper layer at the heel region of the article of footwear.

* * * * *